US010950190B2

(12) United States Patent
Lin et al.

(10) Patent No.: US 10,950,190 B2
(45) Date of Patent: Mar. 16, 2021

(54) METHOD AND SYSTEM FOR DETERMINING OVERDRIVE PIXEL VALUES IN DISPLAY PANEL

(71) Applicant: SHENZHEN YUNYINGGU TECHNOLOGY CO., LTD., Shenzhen (CN)

(72) Inventors: Yaoming Lin, Shanghai (CN); Guoqiang Mei, Shanghai (CN); Yongwen Jiang, Shanghai (CN); Wenguang Yang, Shanghai (CN); Yan Lin, Shanghai (CN); Zhenqiang Ma, Shanghai (CN); Yuan Zi, Shanghai (CN)

(73) Assignee: SHENZHEN YUNYINGGU TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/709,253

(22) Filed: Dec. 10, 2019

(65) Prior Publication Data

US 2020/0312256 A1 Oct. 1, 2020

Related U.S. Application Data

(63) Continuation of application No. PCT/CN2019/080899, filed on Apr. 1, 2019.

(51) Int. Cl.
*G09G 3/36* (2006.01)

(52) U.S. Cl.
CPC ... *G09G 3/3607* (2013.01); *G09G 2320/0233* (2013.01); *G09G 2360/16* (2013.01)

(58) Field of Classification Search
CPC combination set(s) only.
See application file for complete search history.

(56) References Cited

U.S. PATENT DOCUMENTS 10,366,674 B1 * 7/2019 Levin ..... G09G 3/20
2013/0113847 A1 * 5/2013 Mori ..... G09G 3/3413 345/690

* cited by examiner

*Primary Examiner* — Md Saiful A Siddiqui
(74) *Attorney, Agent, or Firm* — Bayes PLLC

(57) ABSTRACT

The present disclosure provides a method for determining an overdrive mapping correlation in a display panel. The method includes the following steps. First, a repeating subpixel arrangement is determined. The subpixel arrangement includes at least three sets of subpixels in the display panel. An ideal luminance value of a pattern of the subpixel arrangement is then determined. The pattern includes at least a first set of subpixels displaying a zero pixel value, a second set of subpixels displaying a first nonzero pixel value, and a third set of subpixels displaying a second nonzero pixel value, the first, second and third sets of subpixels respectively arranged one after another. The first nonzero pixel value may be different from the second nonzero gray scale value. An actual luminance value of the pattern of the subpixel arrangement is then determined. An overdrive pixel value is further determined.

20 Claims, 13 Drawing Sheets

500

START PIXEL VALUE

| TARGET PIXEL VALUE | 0 | 8 | 16 | 32 | ... | 255 |
|---|---|---|---|---|---|---|
| 0 | 0 | 0 | 0 | 0 | ... | 0 |
| 8 | 9 | 9 | 9 | 9 | ... | 7 |
| 16 | 18 | 18 | 18 | 17 | ... | 14 |
| 32 | 36 | 36 | 35 | 34 | ... | 28 |
| ... | ... | ... | ... | ... | ... | ... |
| ... | ... | ... | ... | ... | ... | ... |
| 255 | 255 | 255 | 255 | 255 | ... | 255 |

FIG. 5A

METHOD AND SYSTEM FOR DETERMINING OVERDRIVE PIXEL VALUES IN DISPLAY PANEL

CROSS REFERENCE TO RELATED APPLICATION

This application is continuation of International Application No. PCT/CN2019/080899, filed on Apr. 1, 2019, entitled "METHOD AND SYSTEM FOR DETERMINING OVERDRIVE PIXEL VALUES IN DISPLAY PANEL," which is hereby incorporated by reference in its entirety.

BACKGROUND

The disclosure relates generally to display technologies, and more particularly, to method and system for determining overdrive pixel values of subpixels/pixels in a display panel.

In a display panel, gate voltages and source voltages are applied on subpixels or pixels so display data can be inputted into the subpixels/pixels for displaying of images. In a liquid crystal display (LCD) panel, an LC molecule rotes under electric field caused by the corresponding gate voltage and source voltage, and is "charged" when rotating to a desired orientation. A desired grayscale value can then by displayed by the LC molecule. Often, the display data (e.g., inputted by the source line) can change between adjacent frames (e.g., a frame being $1/60^{th}$ of a second) for the display of different images. However, LC molecules can respond sluggishly to the gate/source voltages, e.g., due to RC delays of the transmission of gate voltages and source voltages and the viscosity nature of the LC molecules, resulting the charging time of the LC molecules to be longer than expected. For example, an LC molecule can be charged (e.g., reaching or almost reaching its target source voltage) after several frames have elapsed. In other words, the LC molecule may not be fully charged in a single frame, reducing the luminance value of the subpixel/pixel.

SUMMARY

The disclosure relates generally to display technologies, and more particularly, to method and system for determining overdrive pixel values of subpixels/pixels in a display panel.

In one example, a method for determining an overdrive mapping correlation in a display panel includes the following operations. First, a repeating subpixel arrangement that comprises at least three sets of subpixels in the display panel is determined. An ideal luminance value of a pattern of the subpixel arrangement is then determined. The pattern includes at least a first set of subpixels displaying a zero pixel value, a second set of subpixels displaying a first nonzero pixel value, and a third set of subpixels displaying a second nonzero pixel value. The first, second and third sets of subpixels are respectively arranged one after another, and the first nonzero pixel value is different from the second nonzero gray scale value. An actual luminance value of the pattern of the subpixel arrangement is then determined. Further, an overdrive pixel value from the first pixel value to the second pixel value is determined by matching the actual luminance value of the pattern to the ideal luminance value of the pattern.

In another example, a system for determining an overdrive mapping correlation in a display panel includes a display, a processor, a luminance measuring unit, and a data transmitter. The display has a plurality of subpixels. The processor includes a graphics pipeline configured to generate a plurality of pixel values for the plurality of subpixels in each frame. The processor also includes a pre-processing module configured to determine a repeating subpixel arrangement that comprises at least three sets of subpixels in the display panel and determine an ideal luminance value of a pattern of the subpixel arrangement. The pattern includes at least a first set of subpixels displaying a zero pixel value, a second set of subpixels displaying a first nonzero pixel value, and a third set of subpixels displaying a second nonzero pixel value. The first, second and third sets of subpixels are respectively arranged one after another, the first nonzero pixel value being different from the second nonzero gray scale value. The processor is also configured to determine an actual luminance value of the pattern of the subpixel arrangement and determine an overdrive pixel value from the first pixel value to the second pixel value by matching the actual luminance value of the pattern to the ideal luminance value of the pattern. The luminance measuring unit is configured to measure the actual luminance value of the pattern of the subpixel arrangement and transmit the actual luminance value of the pattern to the pre-processing module. The data transmitter is configured to transmit the plurality of pixel values from the processor to the display in the frame.

In still another example, a non-transitory computer-readable medium is disclosed. The non-transitory computer-readable medium stores a set of instructions, when executed by at least one processor, causes the at least one processor to determine a method for determining an overdrive mapping correlation in a display panel. The method include the following operations. First, a repeating subpixel arrangement that comprises at least three sets of subpixels in the display panel is determined. An ideal luminance value of a pattern of the subpixel arrangement is then determined. The pattern includes at least a first set of subpixels displaying a zero pixel value, a second set of subpixels displaying a first nonzero pixel value, and a third set of subpixels displaying a second nonzero pixel value. The first, second and third sets of subpixels are respectively arranged one after another, and the first nonzero pixel value is different from the second nonzero gray scale value. An actual luminance value of the pattern of the subpixel arrangement is then determined. Further, an overdrive pixel value from the first pixel value to the second pixel value is determined by matching the actual luminance value of the pattern to the ideal luminance value of the pattern.

BRIEF DESCRIPTION OF THE DRAWINGS

The embodiments will be more readily understood in view of the following description when accompanied by the below figures and wherein like reference numerals represent like elements, wherein:

FIG. 5A is a depiction of an example of an overdrive table showing overdrive mapping correlation in accordance with an embodiment;

DETAILED DESCRIPTION

Figure 1:
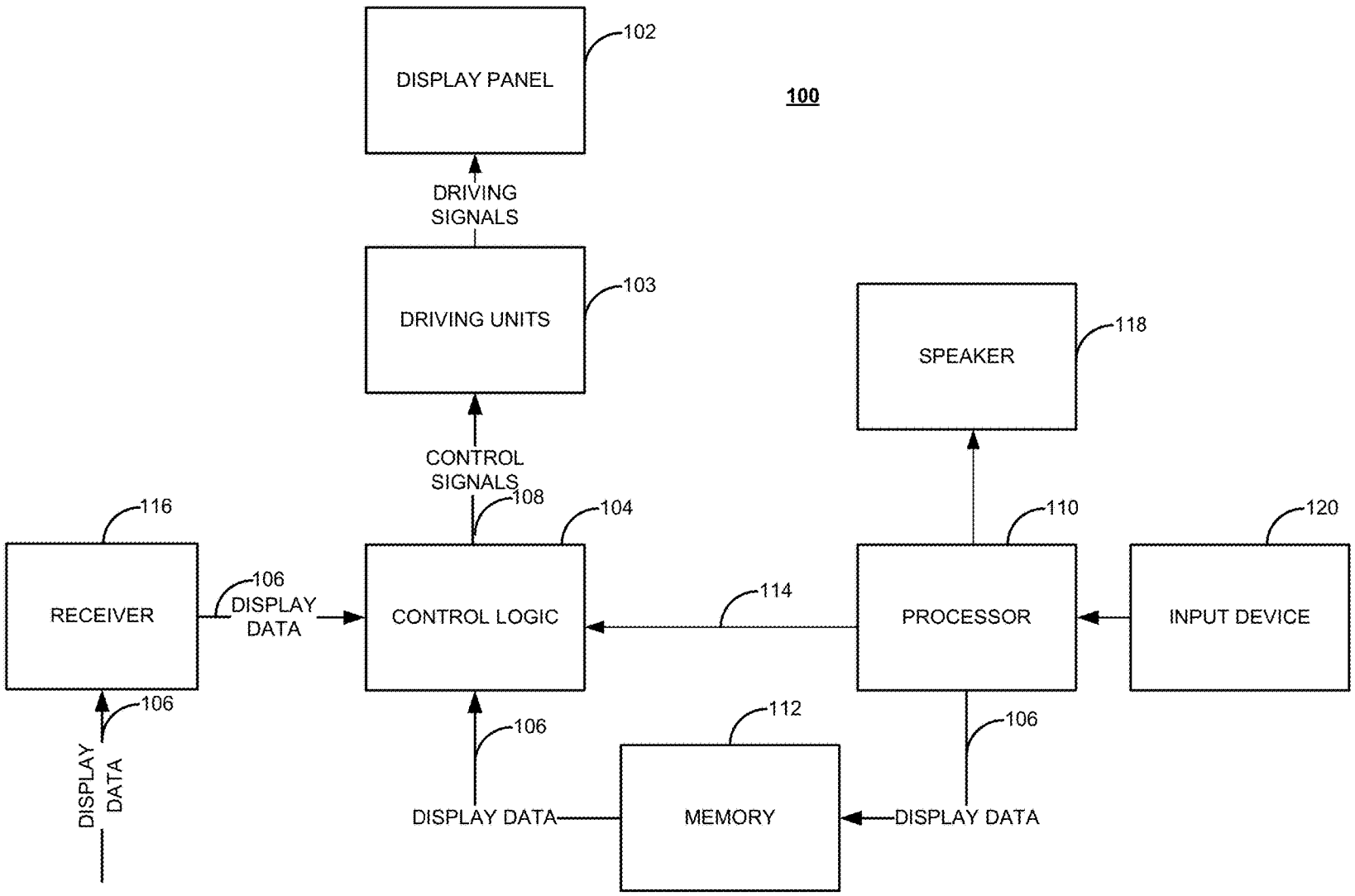
FIG. 1 is a block diagram illustrating an apparatus including a display and control logic in accordance with an embodiment.

In the following detailed description, numerous specific details are set forth by way of examples in order to provide a thorough understanding of the relevant disclosures. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

In the present disclosure, each pixel or subpixel of an LCD panel can be directed to assume a luminance value discretized to the standard set [0, 1, 2, . . . , 255], where a triplet of such pixels/subpixels provides the red (R), green (G), and B (blue) components that make up an arbitrary color which can be updated in each frame. Each of the luminance value corresponds to a different grayscale value. For ease of description, the grayscale value of the subpixels/pixels is also discretized to a standard set [0, 1, 2, . . . , 255], where a triplet of such pixels/subpixels provides the combined grayscale value of arbitrary color. Each luminance value and the corresponding grayscale value correspond to the same driving voltage.

In the present disclosure, an overdrive lookup table (LUT) is employed to describe the mapping correlation between a start pixel value and a target pixel value, which are displayed under a respective driving voltage. An overdrive pixel value (e.g., in the form of a discretized grayscale value as shown in the overdrive LUT) corresponding to the start and target pixel values (or (start pixel value, target pixel value) pair) refers to the pixel value corresponding to an actual driving voltage for compensating deviation in luminance of a subpixel/pixel, so the subpixel/pixel can display the target pixel value. In an example, the subpixels/pixels may be arranged in an array and may extend in rows and columns. According to the mapping correlation, one row of subpixels/pixels may display the start pixel value, and another row of subpixels/pixels may display the target pixel value. Due to the impact of the start pixel value, an overdrive pixel value needs to be inputted into the other row so the other row of subpixels can reach or almost reach the target pixel value in a desired period of time (e.g., a single frame). These two rows may be adjacent to each other (e.g., for a single-gate arrangement) of may be separated from each other (e.g., for a dual-gate arrangement). The overdrive LUT can be configured as a N×N matrix, where N can be an integer less than or equal to 256. Details are described below.

As will be disclosed in detail below, among other novel features, the display system, apparatus, and method disclosed herein can determine the actual driving voltage for a row of subpixels/pixels with improved precision. In some embodiments, the actual driving voltage corresponds to an overdrive pixel value (e.g., an overdrive voltage) inputted by the source writing driver. The overdrive voltage can overdrive the subpixel/pixel and allow the LC molecule to rotate to the desired orientation in a single frame. The subpixel/pixel may display the desired target pixel value in a single frame. The display panel is less susceptible to ghost images. The method can be used to determine the driving pixel values of any suitable voltage-driving display panels. The method can also minimize the impact of the overdriving subpixels/pixels on the merging of colors of different channels.

Specifically, the method employs a repeating arrangement of three sets of subpixels/pixels for determining the driving pixel value that allows subpixel/pixels to display from a start grayscale level to a target grayscale level. In some embodiments, for a single-gate subpixel/pixel arrangement, the three sets of subpixels/pixels are three consecutive rows of subpixels/pixels driven by three gate lines. In some embodiments, for a dual-gate subpixel/pixel arrangement, the three sets of subpixels/pixels are six consecutive rows of subpixel/pixels driven by six gate lines. The subpixel/pixel arrangement may be employed to determine an ideal luminance value and an actual luminance value of a pattern of the subpixel/pixel arrangement. The pattern may include a first set of subpixels/pixels displaying a zero grayscale value, a second set of subpixels/pixels displaying a nonzero start pixel value, and third set of subpixels/pixels displaying a nonzero target pixel value. It is assumed that no overdrive pixel is applied on subpixels/pixels with a start pixel value of zero and a target pixel value of zero. The overdrive pixel value corresponding to the (start pixel value, target pixel value) may be obtained by adjusting the actual driving voltage of the third set of subpixels/pixels so the actual luminance value of the pattern can have a minimum difference with the ideal luminance value. In the method, the ideal and actual luminance values of the pattern may both be obtained by measurement, improving the precision of the determination of overdrive pixel value. In some embodiments, the determination of overdrive pixel value is computed by a processor (or an application processor (AP)), and/or a control logic (or a display driver integrated circuit (DDIC)).

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1 illustrates an apparatus 100 including a display 102, driving units 103, and control logic 104. The apparatus 100 may be any suitable device, for example, a television set, laptop computer, desktop computer, netbook computer, media center, handheld device (e.g., dumb or smart phone, tablet, etc.), electronic billboard, gaming console, set-top box, printer, or any other suitable device. In this example, the display 102 is operatively coupled to the control logic 104 via driving units 103 and is part of the apparatus 100, such as but not limited to, a television screen, computer monitor, dashboard, head-mounted display, or electronic billboard. The display 102 may be a LCD, OLED display, E-ink display, ELD, billboard display with incandescent lamps, or any other suitable type of display. The control logic 104 may be any suitable hardware, software, firmware, or combination thereof, configured to receive display data 106 and render the received display data 106 into control signals 108 for driving the array of subpixels of the display 102 by driving units 103. For example, subpixel rendering algorithms for various subpixel arrangements may be part of the control logic 104 or implemented by the control logic 104. The control logic 104 may include any other suitable components, including an encoder, a decoder, one or more processors, controllers (e.g., timing controller), and storage devices. Examples of the control logic 104 and methods for determining the overdrive pixel values of subpixels in display 102 implemented by the control logic 104 or processor 110 are described in detail with reference to FIGS. 7 and 8, respectively. The apparatus 100 may also include any other suitable component such as, but not limited to, a speaker 118 and an input device 120, e.g., a mouse, keyboard, remote controller, handwriting device, camera, microphone, scanner, etc.

In one example, the apparatus 100 may be a laptop or desktop computer having a display 102. In this example, the apparatus 100 also includes a processor 110 and memory 112. The processor 110 may be, for example, a graphic processor (e.g., GPU), a general processor (e.g., APU, accelerated processing unit; GPGPU, general-purpose computing on GPU), or any other suitable processor. The memory 112 may be, for example, a discrete frame buffer or a unified memory. The processor 110 is configured to generate display data 106 in display frames and temporally store the display data 106 in the memory 112 before sending it to the control logic 104. The processor 110 may also generate other data, such as but not limited to, control instructions 114 or test signals, and provide them to the control logic 104 directly or through the memory 112. The control logic 104 then receives the display data 106 from the memory 112 or from the processor 110 directly.

In another example, the apparatus 100 may be a television set having a display 102. In this example, the apparatus 100 also includes a receiver 116, such as but not limited to, an antenna, radio frequency receiver, digital signal tuner, digital display connectors, e.g., HDMI, DVI, DisplayPort, USB, Bluetooth, WiFi receiver, or Ethernet port. The receiver 116 is configured to receive the display data 106 as an input of the apparatus 100 and provide the native or modulated display data 106 to the control logic 104.

In still another example, the apparatus 100 may be a handheld device, such as a smart phone or a tablet. In this example, the apparatus 100 includes the processor 110, memory 112, and the receiver 116. The apparatus 100 may both generate display data 106 by its processor 110 and receive display data 106 through its receiver 116. For example, the apparatus 100 may be a handheld device that works as both a portable television and a portable computing device. In any event, the apparatus 100 at least includes the display 102 with specifically designed subpixel arrangements as described below in detail and the control logic 104 for the specifically designed subpixel arrangements of the display 102.

Figure 2:
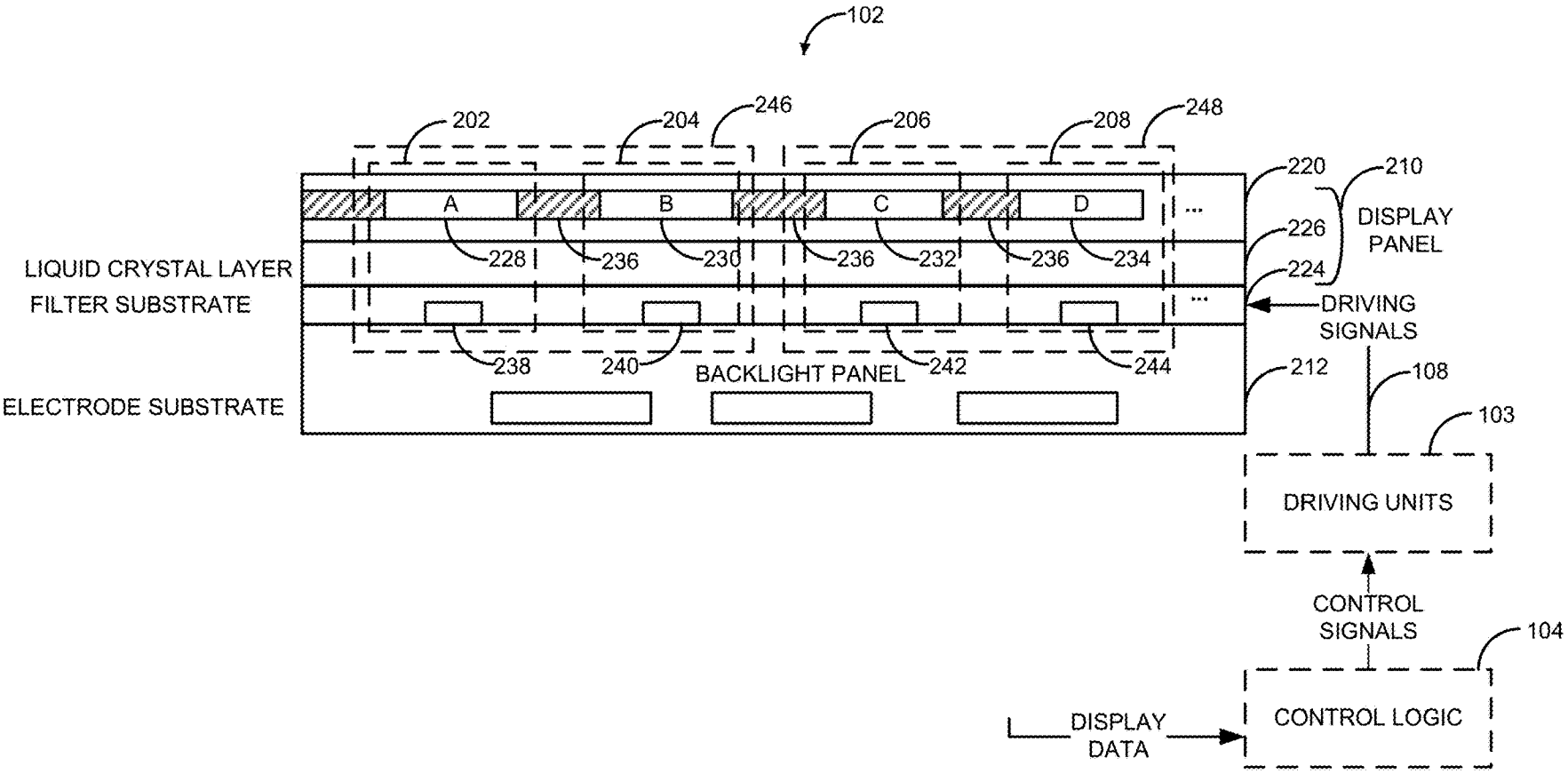
FIG. 2 is a side-view diagram illustrating an example of the display shown in FIG. 1 in accordance with various embodiments.

FIG. 2 illustrates one example of the display 102 including an array of subpixels 202, 204, 206, 208. The display 102 may be any suitable type of display, for example, LCDs, such as a twisted nematic (TN) LCD, in-plane switching (IPS) LCD, advanced fringe field switching (AFFS) LCD, vertical alignment (VA) LCD, advanced super view (ASV) LCD, blue phase mode LCD, passive-matrix (PM) LCD, or any other suitable display. The display 102 may include a display panel 210 and a backlight panel 212, which are operatively coupled to the control logic 104. The backlight panel 212 includes light sources for providing lights to the display panel 210, such as but not limited to, incandescent light bulbs, LEDs, EL panel, cold cathode fluorescent lamps (CCFLs), and hot cathode fluorescent lamps (HCFLs), to name a few.

The display panel 210 may be, for example, a TN panel, an IPS panel, an AFFS panel, a VA panel, an ASV panel, or any other suitable display panel. In this example, the display panel 210 includes a filter substrate 220, an electrode substrate 224, and a liquid crystal layer 226 disposed between the filter substrate 220 and the electrode substrate 224. As shown in FIG. 2, the filter substrate 220 includes a plurality of filters 228, 230, 232, 234 corresponding to the plurality of subpixels 202, 204, 206, 208, respectively. A, B, C, and D in FIG. 2 denote four different types of filters, such as but not limited to, red, green, blue, yellow, cyan, magenta, or white filter. The filter substrate 220 may also include a black matrix 236 disposed between the filters 228, 230, 232, 234 as shown in FIG. 2. The black matrix 236, as the borders of the subpixels 202, 204, 206, 208, is used for blocking the lights coming out from the parts outside the filters 228, 230, 232, 234. In this example, the electrode substrate 224 includes a plurality of electrodes 238, 240, 242, 244 with switching elements, such as thin film transistors (TFTs), corresponding to the plurality of filters 228, 230, 232, 234 of the plurality of subpixels 202, 204, 206, 208, respectively. The electrodes 238, 240, 242, 244 with the switching elements may be individually addressed by the control signals 108 from the control logic 104 and are configured to drive the corresponding subpixels 202, 204, 206, 208 by controlling the light passing through the respective filters 228, 230, 232, 234 according to the control signals 108. The display panel 210 may include any other suitable component, such as one or more glass substrates, polarization layers, or a touch panel, as known in the art.

As shown in FIG. 2, each of the plurality of subpixels 202, 204, 206, 208 is constituted by at least a filter, a corresponding electrode, and the liquid crystal region between the corresponding filter and electrode. The filters 228, 230, 232, 234 may be formed of a resin film in which dyes or pigments having the desired color are contained. Depending on the characteristics (e.g., color, thickness, etc.) of the respective filter, a subpixel may present a distinct color and brightness. In this example, two adjacent subpixels may constitute one pixel for display. For example, the subpixels A 202 and B 204 may constitute a pixel 246, and the subpixels C 206 and D 208 may constitute another pixel 248. Here, since the display data 106 is usually programmed at the pixel level, the two subpixels of each pixel or the multiple subpixels of several adjacent pixels may be addressed collectively by subpixel rendering to present the brightness and color of each pixel, as designated in the display data 106, with the help of subpixel rendering. However, it is understood that, in other examples, the display data 106 may be programmed at the subpixel level such that the display data 106 can directly address individual subpixel without the need of subpixel rendering. Because it usually requires three primary colors (red, green, and blue) to present a full color, specifically designed subpixel arrangements are provided below in detail for the display 102 to achieve an appropriate apparent color resolution.

Figure 3:
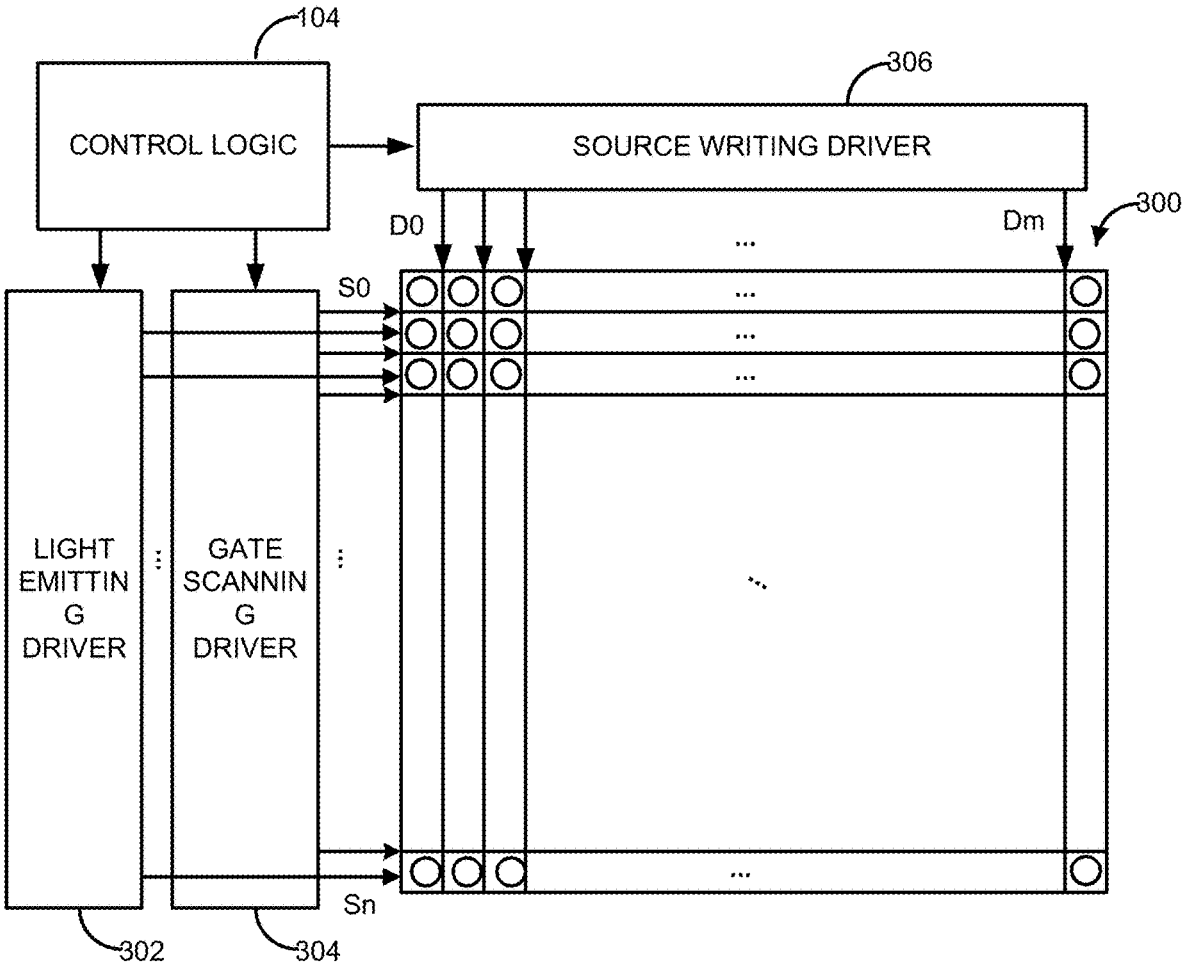
FIG. 3 is a plan-view diagram illustrating the display shown in FIG. 1 including multiple drivers in accordance with an embodiment.

FIG. 3 is a plan-view diagram illustrating driving units 103 shown in FIG. 1 including multiple drivers in accordance with an embodiment. Display panel 210 in this embodiment includes an array of subpixels 300 (e.g., LCDs), a plurality of pixel circuits (not shown), and multiple on-panel drivers including a light emitting driver 302, a gate scanning driver 304, and a source writing driver 306. The pixel circuits are operatively coupled to array of subpixels 300 and on-panel drivers 302, 304, and 306. Light emitting driver 302 in this embodiment is configured to cause array of subpixels 300 to emit lights in each frame. It is to be appreciated that although one light emitting driver 302 is illustrated in FIG. 3, in some embodiments, multiple light emitting drivers may work in conjunction with each other.

Gate scanning driver 304 in this embodiment applies a plurality of scan signals S0-Sn, which are generated based on control signals 108 from control logic 104, to the scan lines (a.k.a. gate lines) for each row of subpixels in array of subpixels 300 in a sequence. The scan signals S0-Sn are applied to the gate electrode of a switching transistor of each pixel circuit during the scan/charging period to turn on the switching transistor so that the data signal for the corresponding subpixel can be written by source writing driver 306. As will be described below in detail, the sequence of applying the scan signals to each row of array of subpixels 300 (i.e., the gate scanning order) may vary in different embodiments. In some embodiments, not all the rows of subpixels are scanned in each frame. It is to be appreciated that although one gate scanning driver 304 is illustrated in FIG. 3, in some embodiments, multiple gate scanning drivers may work in conjunction with each other to scan array of subpixels 300.

Source writing driver 306 in this embodiment is configured to write display data received from control logic 104 into array of subpixels 300 in each frame. For example, source writing driver 306 may simultaneously apply data signals D0-Dm to the data lines (a.k.a. source lines) for each column of subpixels. That is, source writing driver 306 may include one or more shift registers, digital-analog converter (DAC), multiplexers (MUX), and arithmetic circuit for controlling a timing of application of voltage to the source electrode of the switching transistor of each pixel circuit (i.e., during the scan/charging period in each frame) and a magnitude of the applied voltage according to gradations of display data 106. It is to be appreciated that although one source writing driver 306 is illustrated in FIG. 3, in some embodiments, multiple source writing drivers may work in conjunction with each other to apply the data signals to the data lines for each column of subpixels.

Figure 4A:
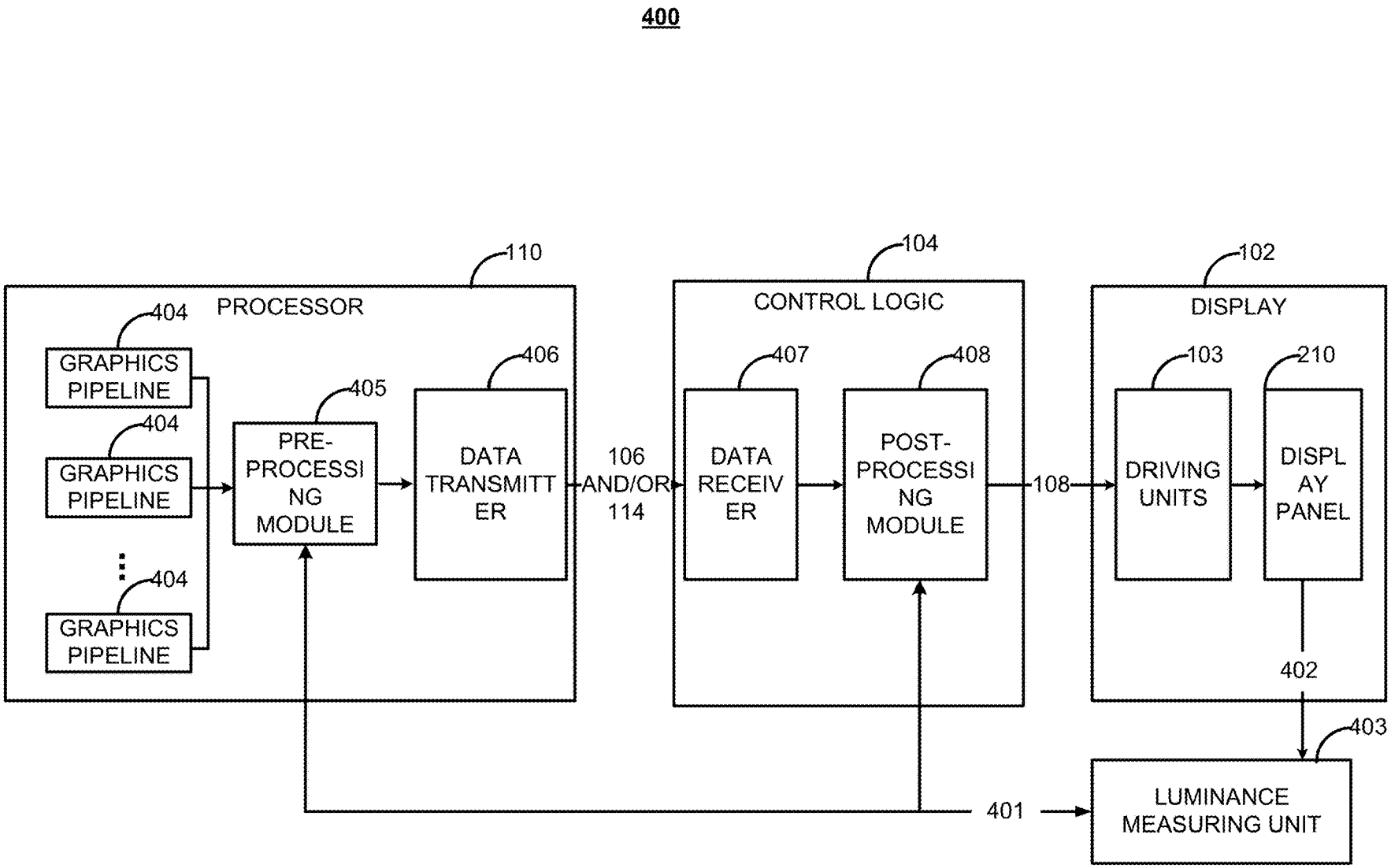
FIG. 4A is a block diagram illustrating a system including a display, a control logic, a processor, and a luminance measuring unit in accordance with an embodiment.

FIG. 4A is a block diagram illustrating a display system 400 including a display 102, control logic 104, a luminance measuring unit 403, and a processor 110 in accordance with an embodiment.

As described above, processor 110 may be any processor that can generate display data 106, e.g., pixel data/values, in each frame and provide display data 106 to control logic 104. Processor 110 may be, for example, a GPU, AP, APU, or GPGPU. Processor 110 may also generate other data, such as but not limited to, control instructions 114 or test signals (not shown in FIG. 4A) and provide them to control logic 104. The stream of display data 106 transmitted from processor 110 to control logic 104 may include original display data and/or compensation data for pixels on display panel 210. In some embodiments, control logic 104 includes a data receiver 407 that receives display data 106 and/or control instructions 114 from processor 110. Post-processing module 408 may be coupled to data receiver 407 to receive any data/instructions and convert it to control signals 108. Measurement data 401 may represent a two-way data flow. Pre-processing module 405 and/or post-processing module 409 may transmit measurement instructions (e.g., for the measurement of display panel 210) to a luminance measuring unit 403 via measurement data 401, and luminance measuring unit 403 may transmit any results of measurement to pre-processing module 405 and/or post-processing module 409 via measurement data 401. Receiving the measurement instructions, luminance measuring unit 403 may perform corresponding measurement and receive raw measurement data from display panel 210.

In this embodiment, processor 110 includes graphics pipelines 404, a pre-processing module 405, and a data transmitter 406. Each graphics pipeline 404 may be a two-dimensional (2D) rendering pipeline or a three-dimensional (3D) rendering pipeline that transforms 2D or 3D images having geometric primitives in the form of vertices into pieces of display data, each of which corresponds to one pixel on display panel 210. Graphics pipeline 404 may be implemented as software (e.g., computing program), hardware (e.g., processing units), or combination thereof. Graphics pipeline 404 may include multiple stages such as vertex shader for processing vertex data, rasterizer for converting vertices into fragments with interpolated data, pixel shader for computing lighting, color, depth, and texture of each piece of display data, and render output unit (ROP) for performing final processing (e.g., blending) to each piece of display data and write them into appropriate locations of a frame buffer (not shown). Each graphics pipeline 404 may independently and simultaneously process a set of vertex data and generate the corresponding set of display data in parallel.

In this embodiment, graphics pipelines 404 are configured to generate a set of original display data in each frame on display panel 210. Each piece of the set of original display data may correspond to one pixel of the array of pixels on display panel 210. For example, for a display panel having a resolution of 2400×2160, the set of original display data generated by graphics pipelines 404 in each frame includes 2400×2160 pieces of the set of original display data, each of which represents a set of values of electrical signals to be applied to the respective pixel (e.g., consisting of a number of subpixels). The set of original display data may be generated by graphics pipelines 404 at a suitable frame rate (e.g., frequency) at which consecutive display frames are provided to display panel 210, such as 30 fps, 60 fps, 72 fps, 120 fps, or 240 fps.

Figure 4B:
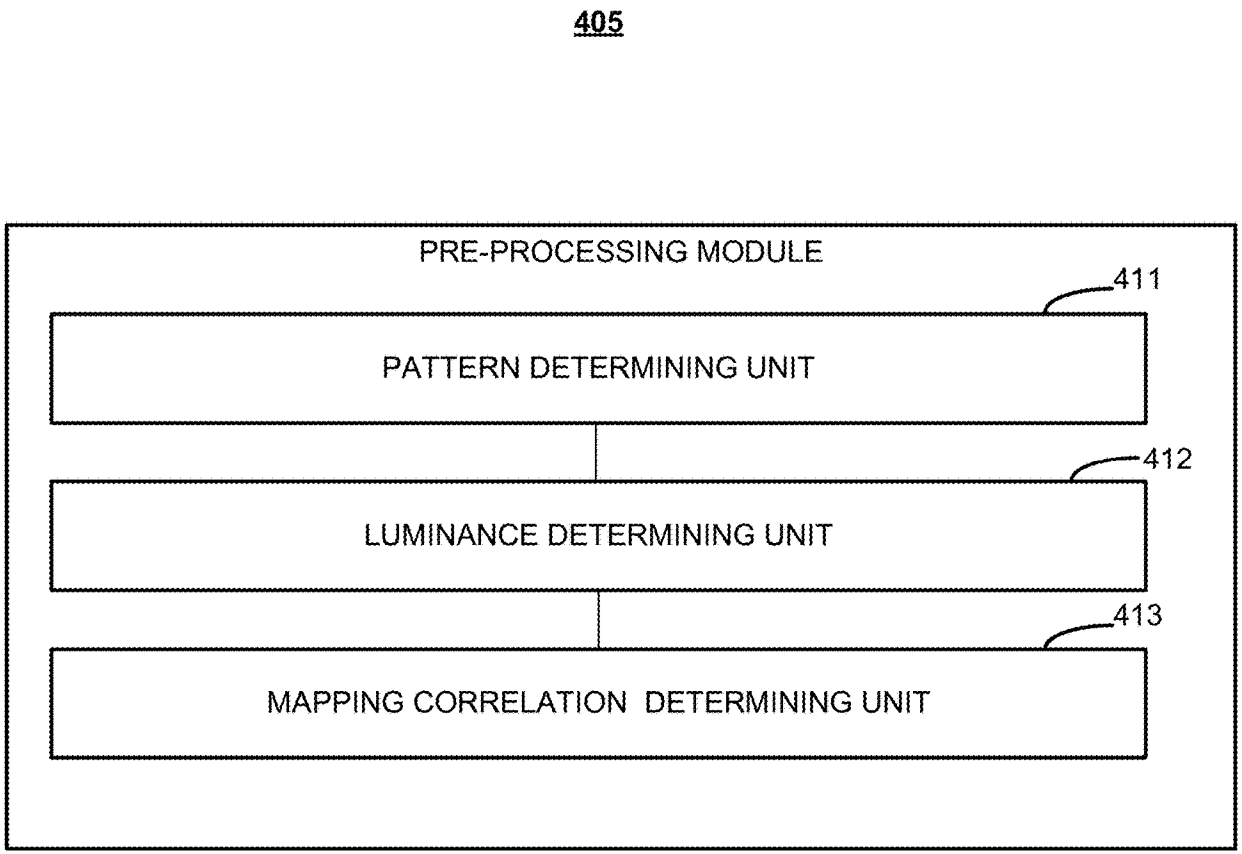
FIG. 4B is a detailed block diagram illustrating one example of a pre-processing module in the processor shown in FIG. 4A in accordance with an embodiment.
Figure 4C:
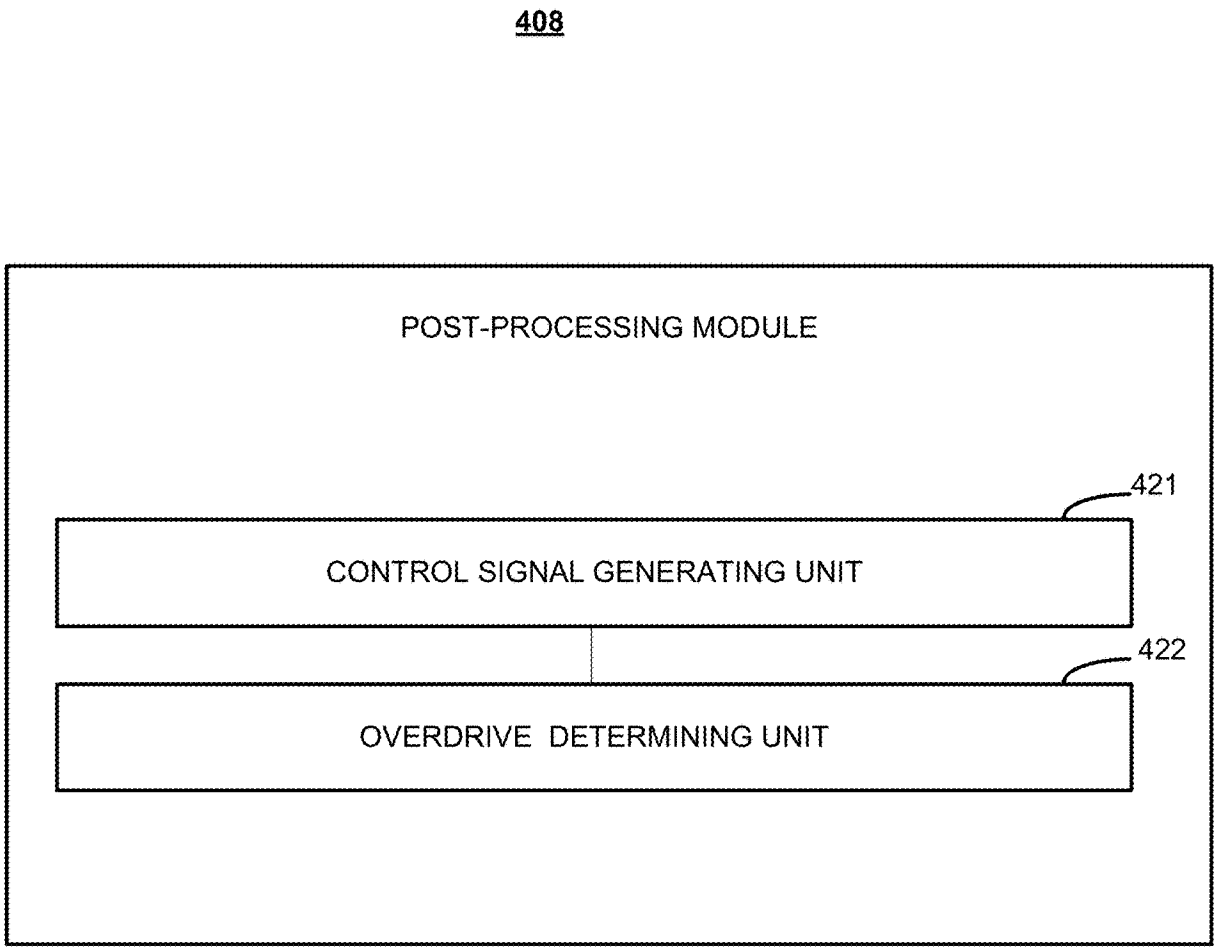
FIG. 4C is a detailed block diagram illustrating one example of a post-processing module in the control logic shown in FIG. 4A in accordance with an embodiment.
Figure 5B:
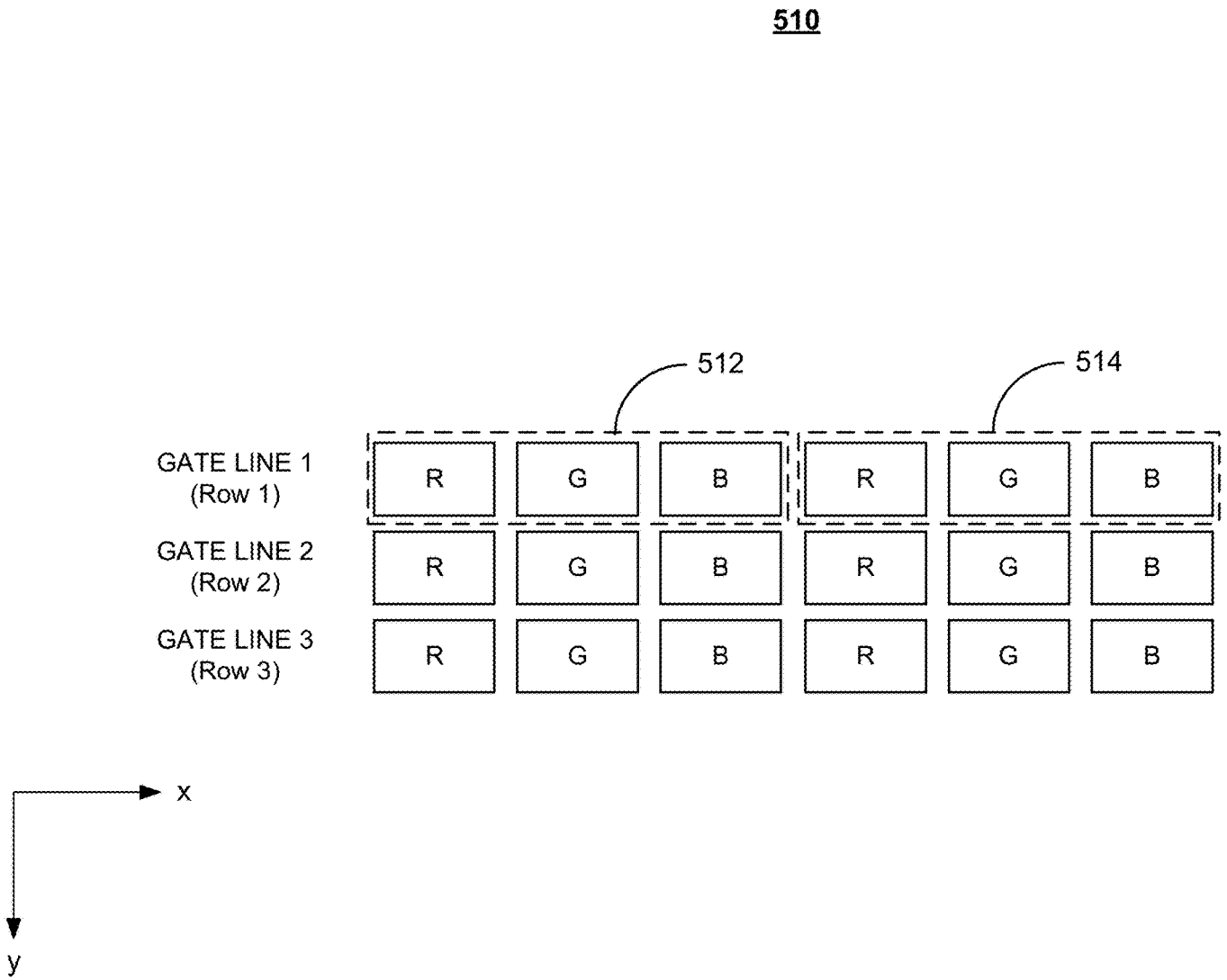
FIG. 5B is a depiction of an example of a subpixel arrangement in accordance with an embodiment.
Figure 5C:
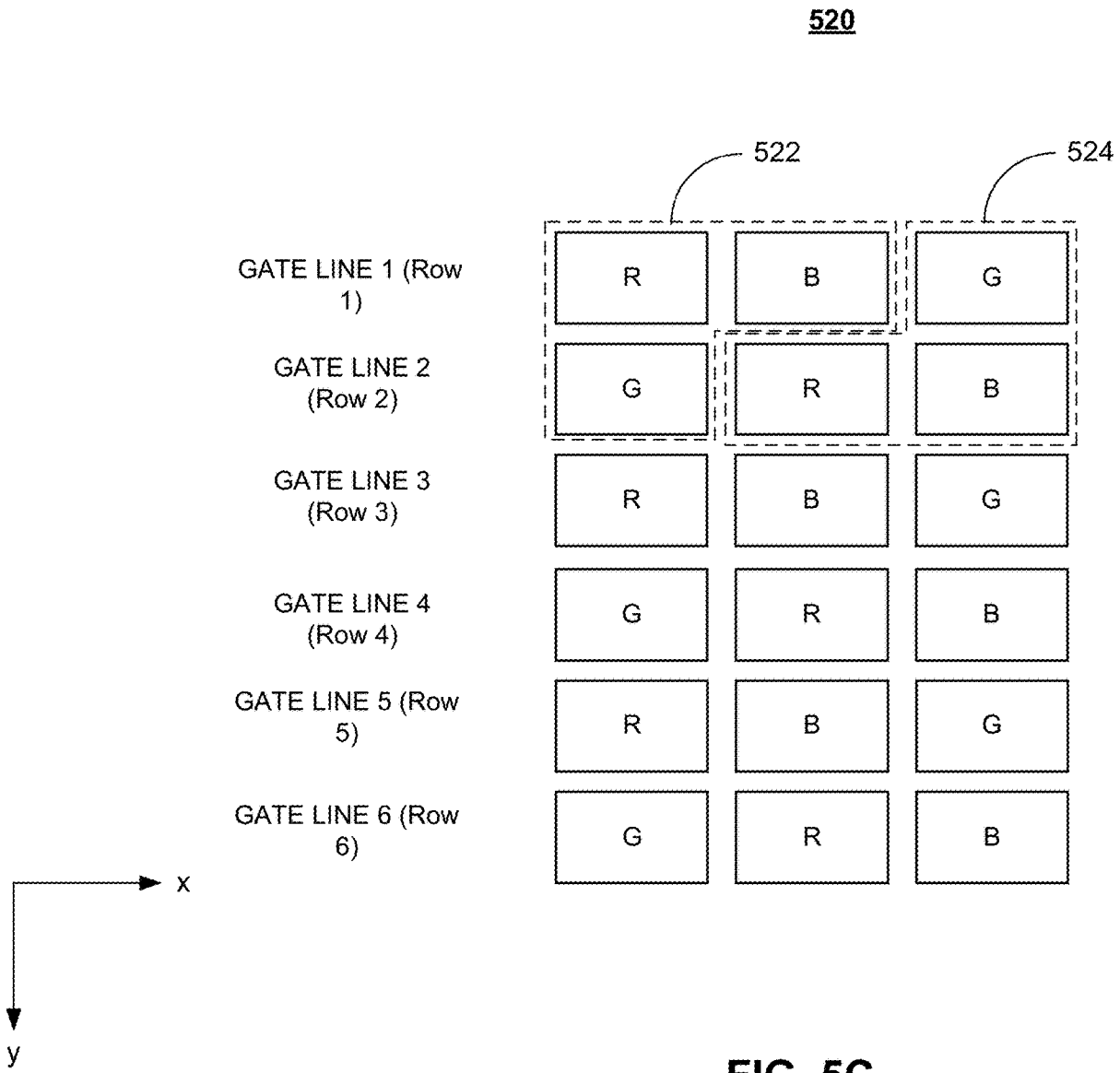
FIG. 5C is a depiction of another example of a subpixel arrangement in accordance with an embodiment.

In this embodiment, pre-processing module 405 is operatively coupled to graphics pipelines 404 and configured to process the original display data of display panel 210 provided by graphics pipelines 404 to, e.g., determine pixel values (or overdrive voltages). FIG. 4B is a detailed block diagram illustrating one example of pre-processing module 405 in processor 110 shown in FIG. 4A in accordance with an embodiment. FIG. 4C is a detailed block diagram illustrating one example of post-processing module 408 in control logic 104 shown in FIG. 4A in accordance with an embodiment. FIG. 5A illustrates an exemplary mapping correlation of a plurality of (start pixel value, target pixel value) pairs in accordance with an embodiment. FIGS. 5B and 5C each illustrates an exemplary subpixel/pixel arrangement in accordance with an embodiment. Operations of pre-processing module 405 and post-processing module 408 are explained in view of FIGS. 5A-5C. In this embodiment, pre-processing module 405 includes a pattern determining unit 411, a luminance determining unit 412, and a mapping correlation determining unit 413.

In some embodiments, pre-processing module 405 determines a mapping correlation (p, q)→(p, q'), wherein (p, q) represents a (start pixel value, target pixel value) pair and (p, q') represents a (start pixel value, overdrive pixel value) pair, which represents that, for the start pixel value p, overdrive pixel value q' is applied on the subpixels/pixels for displaying target pixel value q to overdrive the subpixel/pixel to display the luminance value corresponding to the target pixel value in a desired time period (e.g., single frame). Driven by overdrive pixel value q', the actual luminance value of the subpixel/pixel can reach or almost reach luminance value corresponding to target pixel value q in a single frame under the impact of start pixel value p. The mapping correlation may be determined by mapping correlation determining unit 413. Overdrive pixel value q' may compensate any deviation or defects (e.g., caused by the displaying of start pixel value p) in the luminance of the subpixel/pixel for displaying target pixel value q. An example of the mapping correlation of a plurality of selected/sample (start pixel value, overdrive pixel value) pairs is depicted as a LUT shown in FIG. 5A, where each (start pixel value, target pixel value) pair is mapped to an overdrive pixel value. Details of the LUT is described as follow.

In some embodiments, pre-processing module 405 determines a subpixel arrangement for determining various luminance values. This operation may be performed by pattern determining unit 411. Pattern determining unit 411 may also determine the pixel values to be inputted into a subpixel arrangement to form different patterns for the measurement and/or calculation of various quantities such as the ideal luminance value of a pattern displaying a pixel value. The subpixel arrangement may include three sets of subpixels arranged in display panel 210. In some embodiments, the three sets of subpixels may be arranged consecutively in display panel 210. In some embodiments, display panel 210 includes a plurality of subpixels (e.g., similar to or the same as subpixels 202, 204, 206, and 208 illustrated in FIG. 2) arranged in an array along the x-direction (also referred to as the row direction) and the y-direction (also referred to as the column direction). The array may include a plurality of rows of subpixels arranged along the column direction. The subpixel arrangement may extend repeatedly along the x-direction and/or the y-direction.

FIG. 5B illustrates an exemplary subpixel arrangement 510, according to an embodiment of the present disclosure. Along the row direction, a plurality of pixels (e.g., 512 and 514) may be arranged repeatedly and form a row of subpixels. Each pixel may include three subpixels, respectively displaying red color (R), green color (G), and blue color (B). In some embodiments, each column may include a plurality of subpixels of the same color, as shown in FIG. 5B. In some embodiments, gate scanning driver 304 is coupled with each row of subpixels via one gate line and sequentially drives the rows of subpixels along the column axis. That is, subpixel arrangement 510 may have a single-gate arrangement. Source writing driver 306 may be coupled to each column of subpixels and input display data (e.g., including pixel values) of each row when the corresponding gate voltage is applied on the row. Subpixel arrangement 510 may include at least three rows of subpixels, each coupled to a corresponding gate line. In some embodiments, subpixel arrangement 510 includes three consecutive rows (rows 1, 2, and 3) of subpixels, respective coupled to gate lines 1, 2, and 3 along the column direction, as shown in FIG. 5B. Each row of subpixels may correspond to a different set of subpixels.

FIG. 5C illustrates another subpixel arrangement 520, according to an embodiment of the present disclosure. Different from subpixel arrangement 510, subpixel arrangement 520 may be a dual-gate arrangement, where each subpixel of subpixel arrangement 520 may be coupled to and driven by two gate lines. Subpixel arrangement 520 may be arranged repeatedly along the x-direction and the y-direction. As shown in FIG. 5C, each pixel (e.g., 522 and 524) may be coupled to and driven by two gate lines (e.g., gate lines 1 and 2). In some embodiments, subpixels of one pixel (e.g., 522 and 524) are distributed in two adjacent rows (e.g., rows 1 and 2). Subpixel arrangement 520 may include at least six rows of subpixels, each coupled to a corresponding gate line. In some embodiments, subpixel arrangement 520 includes six consecutive rows (rows 1-6) of subpixels, respective coupled to gate lines 1-6 along the column direction, as shown in FIG. 5B. Each two rows of subpixels that form the respective pixels may correspond to a different set of subpixels. For example, subpixels in rows 1 and 2, 3 and 4, and 5 and 6 may each correspond to a different set of subpixels.

In some embodiments, pre-processing module 405 determines various luminance values for the calculation of an overdrive pixel value. This operation may be performed by luminance determining unit 412. In some embodiments, pattern determining unit 411 determines a pattern by inputting desired pixel values into subpixel arrangement 510 or 520 to generate a pattern, and luminance determining unit 412 determines the ideal luminance value of the pattern. Pattern determining unit 411 may input various pixel values into the subpixel arrangement (e.g., 510 or 520) to generate different patterns for the determination of various ideal and/or actual luminance values.

Pre-processing module 405 may determine the ideal luminance value of one set of subpixels displaying pixel value x.

Integer x may be any suitable number between 0 and 255. In some embodiments, pattern determining unit 411 determines the total ideal luminance value of the three sets of subpixels when each of the three sets of subpixels display a pixel value of x. Pixel value x may be inputted into all the subpixels in the pixel arrangement to form a pattern, in which the three sets of subpixels may simultaneously display pixel value x. In some embodiments, luminance measuring unit 403 measures the total actual luminance value of the pattern and transmit the result of measurement (e.g., via measurement data 401) to pre-processing module 405 (or luminance determining unit 412), which may store the total actual luminance value of the pattern as the total ideal luminance value of the pattern displaying pixel value x. Luminance measuring unit 403 may include any software and/or hardware configured to measure the luminance of the pattern. For example, luminance measuring unit 403 may include a luminance meter and/or a colorimeter.

In some embodiments, pattern determining unit 411 may input pixel value x into all three sets of subpixels of the subpixel arrangement. In some embodiments, all three rows of subpixels in subpixel arrangement 510 display luminance of pixel value x, forming a respective pattern (x, x, x), representing each row of the subpixel arrangement displaying pixel value x. The total actual luminance value of pattern (x, x, x) may be measured to be Lv(x, x, x). It may be determined that the total ideal luminance value iLv(x) of pattern (x, x, x) is equal to Lv(x, x, x). Likewise, in some embodiments, all six rows of subpixels in subpixel arrangement 520 display luminance of pixel value x to form a respective pattern (x, x, x, x, x, x), and the total actual luminance value of pattern (x, x, x, x, x, x) may be measured to be Lv(x, x, x, x, x, x). The total ideal luminance value iLv(x) of pattern (x, x, x, x, x, x) may be determined to be Lv(x, x, x, x, x, x). In some embodiments, ⅓×iLv(x) represents the ideal luminance value of each row of pattern (x, x, x), and ⅓×iLv(x) represents the ideal luminance value of two rows of pattern (x, x, x, x, x, x).

Pre-processing module 405 may also determine the actual luminance value of a pattern in which one set of subpixels display a nonzero pixel value y, and the other two sets of subpixels adjacent to this set of subpixels display a zero pixel value. This operation may be performed by pattern determining unit 411 and luminance determining unit 412. The nonzero pixel value y can be any suitable integer between 1 and 255. In some embodiments, pattern determining unit 411 inputs pixel value 0 into subpixels in rows 1 and 3 of subpixel arrangement 510, and inputs a nonzero pixel value y into subpixels in row 2, forming a respective pattern (0, y, 0). In some embodiments, pattern determining unit 411 inputs pixel value 0 into rows 1, 3, 4, and 6, forming a respective pattern (0, y, 0, 0, y, 0). Luminance measuring unit 403 may measure the actual luminance value of pattern (0, y, 0) of subpixel arrangement 510 or the actual luminance value of pattern (0, y, 0, 0, y, 0) of subpixel arrangement 520, and transmit the result of measurement (e.g., via measurement data 401) to pre-processing module 405. Luminance determining unit 412 may store the actual luminance values respectively as Lv(0, y, 0) and Lv(0, y, 0, 0, y, 0).

In some embodiments, pre-processing module 405 may determine an ideal luminance value and an actual luminance value of a pattern in which one set of subpixels display a zero pixel value, a another set of subpixels display a start pixel value (e.g., a first nonzero pixel value), and a third set of subpixels display a target pixel value (e.g., a second nonzero pixel value). The start pixel value and the target pixel value may each be between 1 and 255. This operation may be performed by pattern determining unit 411 and luminance determining unit 412. For example, pre-processing module 405 may determine an ideal luminance value of a pattern (0, x, y) for subpixel arrangement 510 and an ideal luminance value of a pattern (0, x, y, 0, x, y) for subpixel arrangement 520. In each pattern, pixel value x may represent a start pixel value, and pixel value y may represent a target pixel value, where x and y may each be a nonzero value. For example, pre-processing module 405 may determine the ideal luminance value of pattern (0, x, y), stored as iLv(0, x, y), by determining an actual luminance value of pattern (0, x, 0), an ideal luminance value of pixel value y, and an ideal luminance value of pixel value 0. That is, iLv(0, x, y)=Lv(0, x, 0)+⅓×iLv(y)−⅓×iLv(0). According to previous description, Lv(0, x, 0) may be obtained by measuring the actual luminance value of pattern (0, x, 0); and iLv(y) and iLv(0) may respectively be obtained by measuring the actual total luminance values of patterns (y, y, y) and (0, 0, 0). That is, the ideal luminance value of pattern (0, x, y) can be obtained based on measurement of actual luminance values of patterns (0, x, 0), (y, y, y), and (0, 0, 0). Similarly, the ideal luminance value of pattern (0, x, y, 0, x, y) for subpixel arrangement 520 may be calculated as iLv(0, x, y, 0, x, y)=Lv(0, x, 0, 0, x, 0)+⅓×iLv(y)−⅓×iLv(0). In some embodiments, the actual luminance value of pattern (0, x y) is stored as Lv(0, x, y), and the actual luminance value of pattern (0, x, y, 0, x, y) is stored as Lv (0, x, y, 0, x, y). The quantities constituting the ideal and actual luminance values of patterns (0, x, y) and (0, x, y, 0, x, y) may be measured by luminance measuring unit 403 and transmitted to pre-processing module 405.

Pre-processing module 405 may also determine a mapping correlation between a start pixel value x and a target pixel value y by determining an overdrive pixel value mapped to the (x, y) pair. This operation may be performed by mapping correlation determining unit 413. When the ideal luminance value of pattern (0, x, y) or (0, x, y, 0, x, y) is different from its respective actual luminance value, mapping correlation determining unit 413 may adjust the actual pixel value y' applied on the set of subpixels that display target pixel value y so the actual luminance value of the pattern may approach or be nominally the same as the ideal luminance value of the pattern. The actual pixel value y' may be stored as the overdrive pixel value for (start pixel value, target pixel value) pair or (x, y). The operation is described below using pattern (0, x, y) as an example. The operation to determine the overdrive pixel value mapped to a (start pixel value, target pixel value) pair of (x, y) of pattern (0, x, y, 0, x, y) is the same as or similar to the process described below and is not repeated herein.

First, pre-processing module 405 (or mapping correlation determining unit 413) may compare the ideal and actual luminance values of pattern (0, x, y). If the ideal luminance value is equal to the actual luminance values, the overdrive pixel value is equal to the target pixel value y.

If the ideal luminance value is greater than the actual luminance values of pattern, pre-processing module 405 may increase the actual pixel value y' applied on row 3 of the subpixels in subpixel arrangement 510 at a step length of L, which is a positive integer. Pre-processing module 405 may continue to compare the ideal luminance value with the adjusted luminance values (e.g., the actual luminance value corresponding to the actual pixel value inputted into subpixels of row 3) until the ideal luminance value falls between two adjacent adjusted luminance values. That is, when Lv(0, x, y)<iLv(0, x, y), pre-processing module 405 may increase the actual pixel value y' inputted into row 3 of subpixel arrangement 510 to obtain actual adjusted luminance value Lv(0, x, y'), where the step length of increment is L. Pre-processing module 405 may continue to compare the ideal luminance value with the adjusted luminance values before and after an increment until the ideal luminance value falls in between the two adjacent adjusted luminance values. That is, pre-processing module 405 may continue to increase the actual pixel value y' for m times, each time by a step length of L, and stop increasing the actual pixel value y' when the condition of $Lv(0, x, y+(m-1)\times L)<iLv(0, x, y)<Lv(0, x, y+m\times L)$ is satisfied, where $Lv(0, x, y+(m-1)\times L)$ represents the $(m-1)^{th}$ adjusted luminance value and $Lv(0, x, y+m\times L)$ represents the $m^{th}$ adjusted luminance value. That is, the overdrive pixel value (e.g., the actual pixel value y' inputted into the subpixels of row 3 of subpixel arrangement 510 when the condition is satisfied) is equal to $(y+(m-1)\times L)$ if $(iLv(0, x, y)-Lv(0, x, y+(m-1)\times L))$ is less than $(Lv(0, x, y+m\times L)-iLv(0, x, y))$; and is equal to $(y+m\times L)$ if else. The overdrive pixel value may then be equal to the adjusted pixel value that causes a smaller difference between the ideal luminance value and the adjusted luminance value. In some embodiments, L is equal to 1.

If the ideal luminance value is less than the actual luminance values of pattern, pre-processing module 405 may decrease the actual pixel value y' applied on row 3 of the subpixels in subpixel arrangement 510 at a step length of K, which is a positive integer. Pre-processing module 405 may continue to compare the ideal luminance value with the adjusted luminance values (e.g., the actual luminance value corresponding to the actual pixel value inputted into subpixels of row 3) until the ideal luminance value falls between two adjacent adjusted luminance values. That is, when $Lv(0, x, y)>iLv(0, x, y)$, pre-processing module 405 may decrease the actual pixel value y' inputted into row 3 of subpixel arrangement 510 to obtain actual adjusted luminance value Lv(0, x, y'), where the step length of decrement is K. Pre-processing module 405 may continue to compare the ideal luminance value with the adjusted luminance values before and after a decrement until the ideal luminance value falls in between the two adjacent adjusted luminance values. That is, pre-processing module 405 may continue to decrease the actual pixel value y' for n times, each time by a step length of K, and stop decreasing the actual pixel value y' when the condition of $Lv(0, x, y-n\times K)<iLv(0, x, y)<Lv(0, x, y-(n-1)\times K)$ is satisfied, where $Lv(0, x, y-(n-1)\times K)$ represents the $(n-1)^{th}$ adjusted luminance value and $Lv(0, x, y-n\times K)$ represents the $n^{th}$ adjusted luminance value. That is, the overdrive pixel value (e.g., the actual pixel value y' inputted into the subpixels of row 3 of subpixel arrangement 510 when the condition is satisfied) is equal to $(y-(n-1)\times K)$ if $(Lv(0, x, y-(n-1)\times K-iLv(0, x, y))$ is less than $(iLv(0, x, y)-Lv(0, x, y+n\times K))$; and is equal to $(y-n\times K)$ if else. The overdrive pixel value may then be equal to the adjusted pixel value that causes a smaller difference between the ideal luminance value and the adjusted luminance value. In some embodiments, K is equal to 1.

Pre-processing module 405 (or mapping correlation determining unit 413) may then determine the overdrive pixel value corresponding to the start pixel value x and the target pixel value y. In some embodiments, the mapping correlation between a start pixel value x and a target pixel value y is stored in a LUT 500, as shown in FIG. 5A. As an example, a (start pixel value, target pixel value) pair of (16, 32) corresponds to an overdrive pixel value of 17. In some embodiments, pre-processing module 405 may repeatedly determine (e.g., perform a loop operation) the overdrive pixel value for a plurality of selected (or sampling) (start pixel value, target pixel value) pairs, as described above, and forming the LUT 500. The number of start and target pixel values may be any suitable positive integers that are less than 256. For example, the start and target pixel values may each be one of 16, 32, 48, 64, 80, 96, 112, 128, 144, 160, 176, 192, 208, 224, 240, and 255. In some embodiments, LUT 500 may be a 17 by 17 table that has 17 start pixel values and 17 target pixel values, and the overdrive pixel values mapped to a (start pixel value, target pixel value). In some embodiments, to complete LUT 500, it is assumed that a (start pixel value, target pixel value) pair of (0, nonzero pixel value) is mapped to an overdrive pixel value of 0, and a (start pixel value, target pixel value) pair of (255, zero or nonzero pixel value) is mapped to an overdrive pixel value of 255. In some embodiments, pre-processing module 405 (or mapping correlation determining unit 413) may perform a bilinear interpolation process to determine the overdrive pixel values for (start pixel value, target pixel value) pair not included in the LUT shown in FIG. 5A. In some embodiments, mapping correlation of all (start pixel value, target pixel value) pairs may be completed by performing a bilinear interpolation process on the pixel values provided by LUT 500 to determine the overdrive voltage from a start pixel value (e.g., between 0 and 255) to a target pixel value (e.g., between 0 and 255). In some embodiments, the mapping correlation between all start pixel values and all target pixel values may also be stored as a LUT, e.g., in memory 112.

FIG. 4C illustrates a detailed block diagram illustrating one example of post-processing module 408 in control logic 104 shown in FIG. 4A in accordance with an embodiment. In some embodiments, post-processing module 408 includes a control signal generating unit 421 that generates control signals for display data 106 and control instructions 114 received from pre-processing module 405. In some embodiments, post-processing module 408 includes an overdrive determining unit 422 that can locate/determine an overdrive pixel value for a (start pixel value, target pixel value) pair in a LUT stored in memory 112 (e.g., generated by pre-processing module 405) and generate corresponding control signals based on the overdrive pixel value. The control signals for the overdrive pixel values may be transmitted to display 102 in control signals 108 for controlling the display of corresponding subpixels. In some embodiments, overdrive determining unit 422 is coupled to luminance measuring unit 403 (e.g., via measurement data 401) to receive luminance values measured by luminance measuring unit 403. In some embodiments, overdrive determining unit 422 includes at least a part of the functions of pre-processing module 405. In some embodiments, overdrive determining unit 422 includes all functions of pre-processing module 405 as described above.

In some embodiments, control signal generating unit 421 includes a timing controller (TCON) and a clock signal generator. The TCON may provide a variety of enable signals to driving units 103 of display 102. The clock signal generator may provide a variety of clock signals to driving units 103 of display 102. As described above, control signals 108, including the enable signals and clock signals, can control gate scanning driver 304 to scan corresponding rows of pixels according to a gate scanning order and control source writing driver 306 to write each set of display data (e.g., pixel values to be inputted into subpixels) according to the order of pieces of display data in the set of display data. In other words, control signals 108 can cause the pixels in display panel 210 to be refreshed following a certain order at a certain rate.

Data transmitter 406 may be any suitable display interface between processor 110 and control logic 104, such as but not limited to, display serial interface (DSI), display pixel interface (DPI), and display bus interface (DBI) by the Mobile Industry Processor Interface (MIPI) Alliance, unified display interface (UDI), digital visual interface (DVI), high-definition multimedia interface (HDMI), and DisplayPort (DP). Based on the specific interface standard adopted by data transmitter 406, stream of display data 106 may be transmitted in series in the corresponding data format along with any suitable timing signals, such as vertical synchronization (V-Sync), horizontal synchronization (H-Sync), vertical back porch (VBP), horizontal back porch (HBP), vertical front porch (VFP), and horizontal front porch (HVP), which are used to organize and synchronize stream of display data 106 in each frame with the array of pixels on display panel 210.

Figure 6:
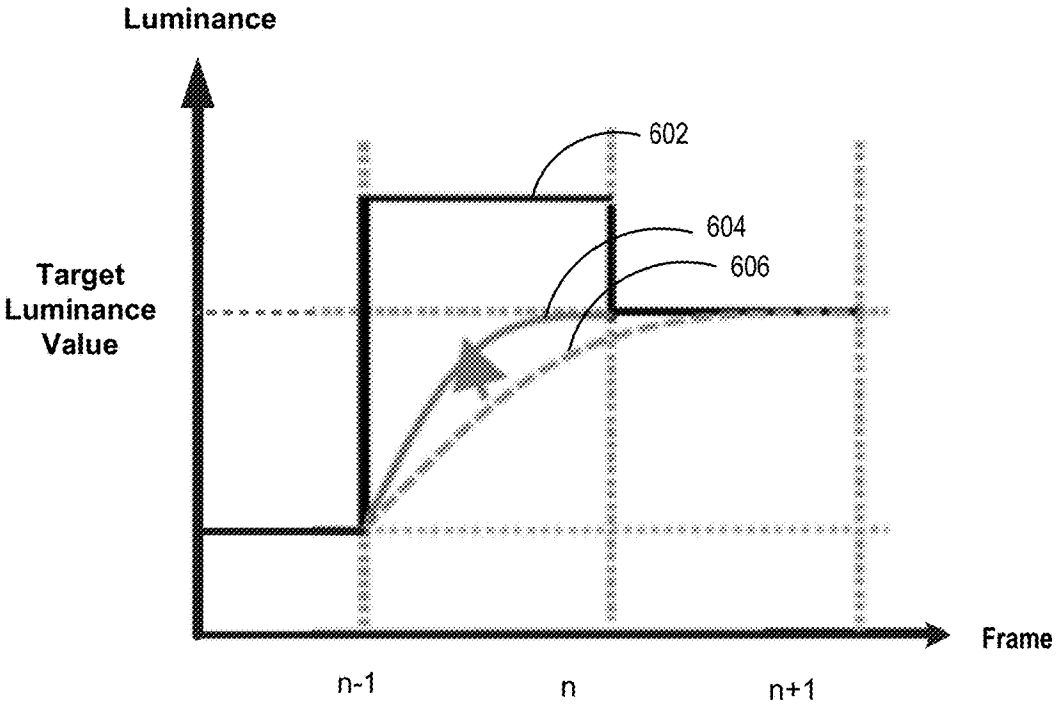
FIG. 6 is a depiction of an example of a comparison between responses of a subpixel with and without applying an overdrive pixel value in accordance with an embodiment.

FIG. 6 illustrates an exemplary plot 600 depicting a comparison between responses of a subpixel with and without applying an overdrive pixel value, according to some embodiments of the present disclosure. As shown in FIG. 6, line 602 represents the luminance value corresponding to an overdrive pixel value, line 606 represents the luminance value of a subpixel without applying the overdrive pixel value, line 604 represents the luminance value of the subpixel after applying the overdrive pixel value. It is shown that in a single frame (e.g., between frame (n−1) and frame n), the luminance value of the subpixel can reach or almost reach a target luminance value when an overdrive pixel value is inputted therein, which is the ideal luminance value corresponding to the target pixel value.

It should be noted that, although the present disclosure is explained using subpixel arrangements having three sets of subpixels, a subpixel arrangement having more than three sets of subpixels may also be used to determine an overdrive pixel value for a (start pixel value, target pixel value) pair. Following the disclosed method, the at least one set of subpixels in addition to the three sets of subpixels may be inputted with a zero pixel value or a nonzero pixel value of which the overdrive pixel value between this nonzero pixel value and adjacent subpixels (e.g., subpixels of adjacent rows) are known. That is, in some embodiments, the addition of subpixels to the three sets of subpixels does not introduce new variables (e.g., unknown quantities) in addition to the overdrive between the (start pixel value, target pixel value) pair.

Figure 7:
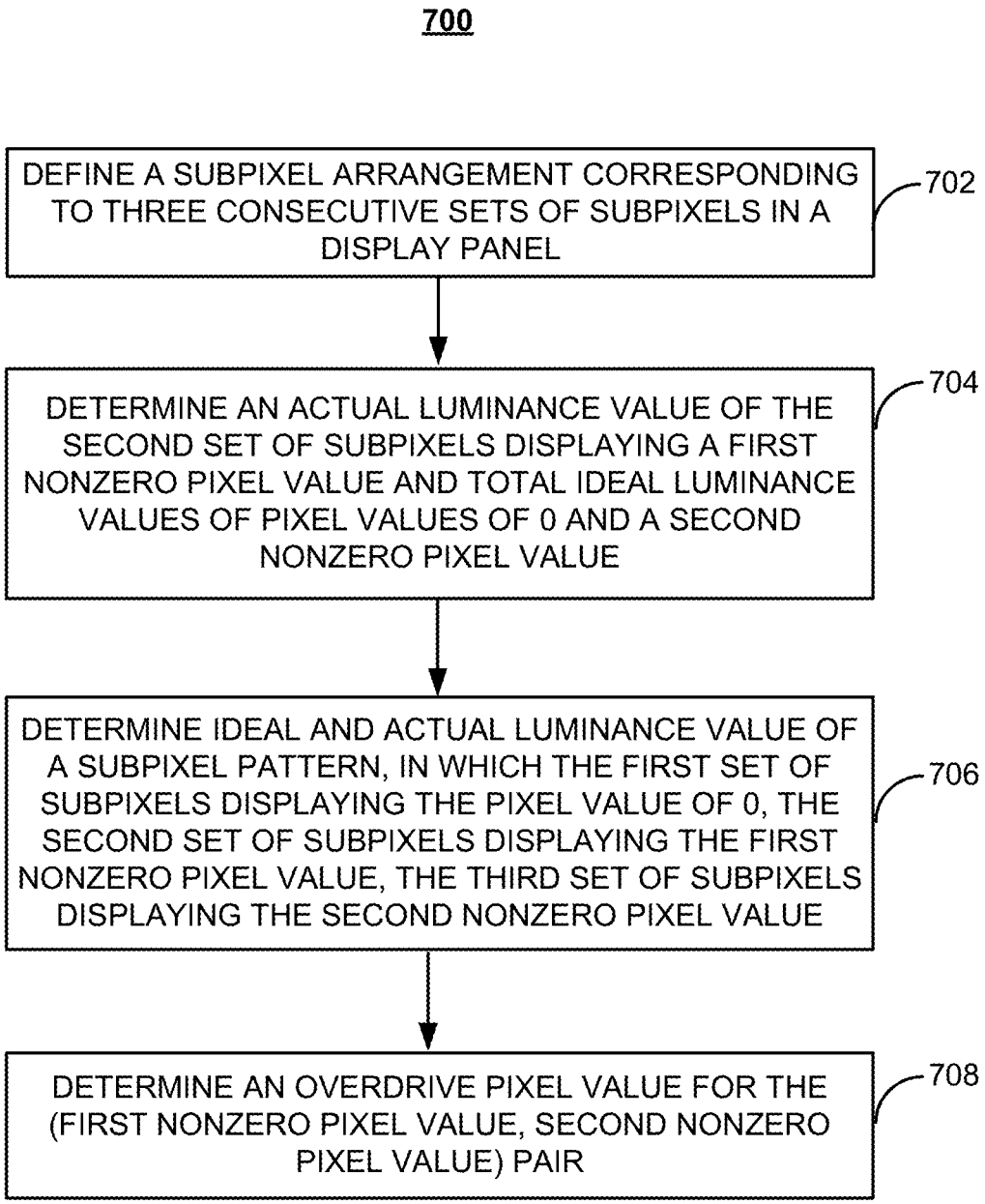
FIG. 7 is a depiction of an exemplary method for determining an overdrive pixel value of a subpixel in accordance with an embodiment.

FIG. 7 is a flow chart of a method 700 for determining the overdrive pixel value of a set of subpixels in accordance with an embodiment. It will be described with reference to the above figures, such as FIGS. 4A-5C. However, any suitable circuit, logic, unit, or module may be employed. The method can be performed by any suitable circuit, logic, unit, or module that can comprise hardware (e.g., circuitry, dedicated logic, programmable logic, microcode, etc.), software (e.g., instructions executing on a processing device), firmware, or a combination thereof. It is to be appreciated that not all steps may be needed to perform the disclosure provided herein. Further, some of the steps may be performed simultaneously, or in a different order than shown in FIG. 7, as will be understood by a person of ordinary skill in the art.

Starting at 702, a subpixel arrangement may be defined. The subpixel arrangement may include three consecutive sets of subpixels in a display panel. The subpixels may be coupled to gate lines through a single-gate arrangement or a dual-gate arrangement. For a single-gate arrangement, the subpixel arrangement may include three consecutive rows of subpixels. For a dual-gate arrangement, the subpixel arrangement may include six consecutive rows of subpixels. This process may be performed by pre-processing module 405 or post-processing module 408. At 704, an actual luminance value of the second set of subpixels displaying a first nonzero subpixel value and total ideal luminance values of pixel values of 0 and a second nonzero pixel value may be determined. The actual luminance value of the second set of subpixels displaying the first nonzero pixel value may be obtained by measuring the actual luminance value of a pattern formed from the subpixel arrangement. The pattern may be formed by respectively inputting pixel values of 0, first nonzero pixel value, and 0 into the first, second, and third sets of the subpixel arrangement so that the subpixels of the first and third sets display the pixel value of 0, the subpixels of the second set display the first nonzero pixel value. The total ideal luminance values of pixel values of 0 and the second nonzero pixel value may be obtained by respectively measuring the total actual luminance values of respective patterns formed from the subpixel arrangement. The patterns may be obtained by respectively inputting the pixel values of 0 and the second nonzero pixel value into all the subpixels of the three sets of subpixels. The first nonzero pixel value may be a start pixel value, and the second nonzero pixel value may be a target pixel value. This process may be performed by pre-processing module 405 or post-processing module 408, and luminance measuring unit 403.

At 706, the ideal and actual luminance values of another pattern can be determined, the pattern may include the first set of subpixels displaying the pixel value of 0, the second set of subpixels displaying the first nonzero pixel value, and the third set of subpixels displaying the second nonzero pixel value. The ideal luminance value of this pattern may be calculated based on the actual luminance value of the second set of pixels displaying the first nonzero pixel value, and the total ideal luminance values of pixel values of 0 and the second nonzero pixel value. The actual luminance value of this pattern may be measured. This process may be performed by pre-processing module 405 and luminance measuring unit 403. At 708, an overdrive pixel value for the (first nonzero pixel value, second nonzero pixel value) pair may be determined. The overdrive pixel value may be applied on the set of subpixels for displaying the second nonzero pixel value to overdrive the subpixels. The actual luminance value of the pattern may be adjusted by tuning the overdrive pixel value to approach the ideal luminance value of the pattern. The overdrive pixel value may be determined when the actual and ideal luminance values of the pattern are the same or almost the same. This process may be performed by pre-processing module 405 or post-processing module 408.

Figure 8A:
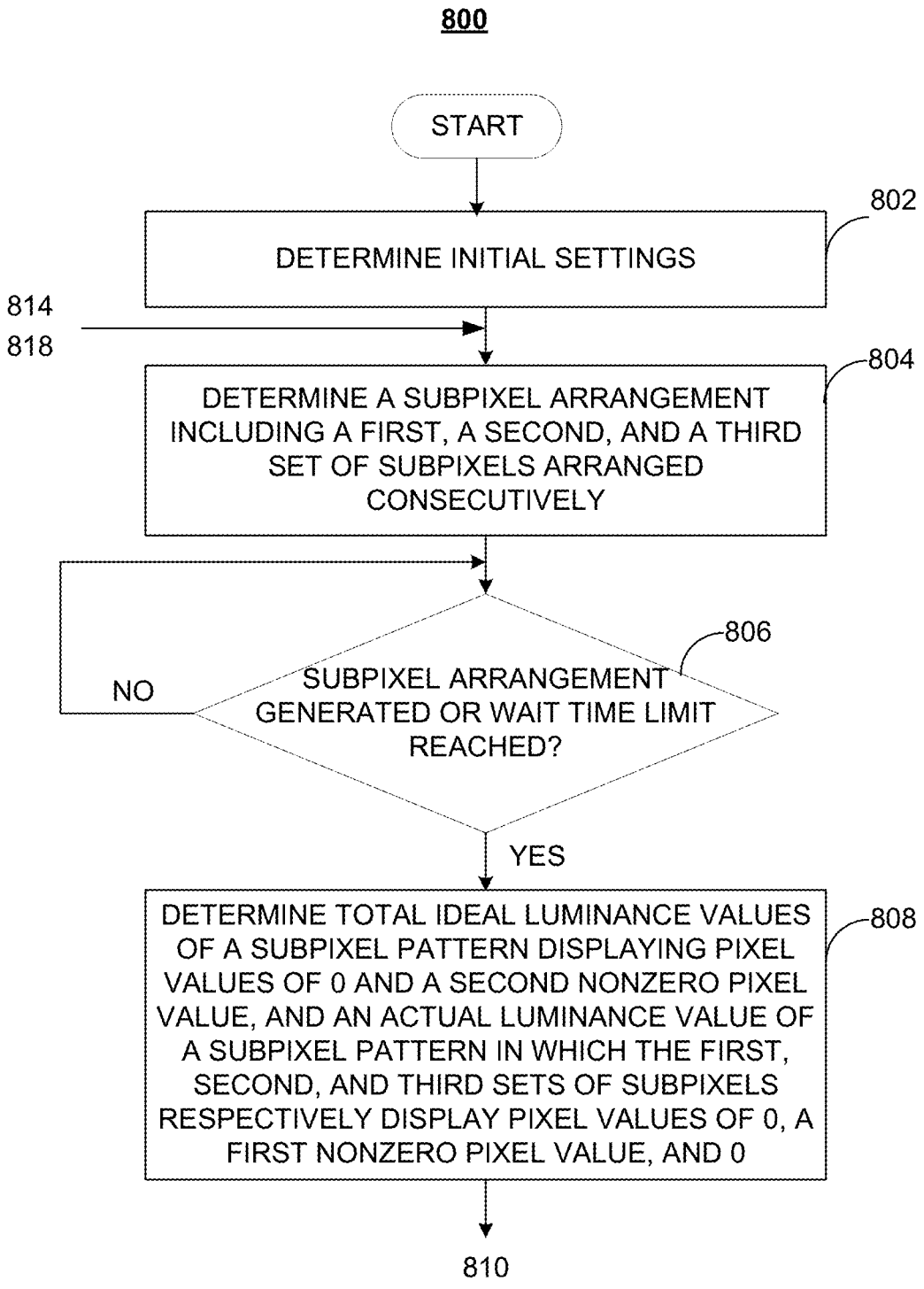
FIGS. 8A and 8B illustrate a depiction of an exemplary method for determining overdrive pixel values of a plurality of selected (start pixel value, target pixel value) pairs in accordance with an embodiment.
Figure 8B:
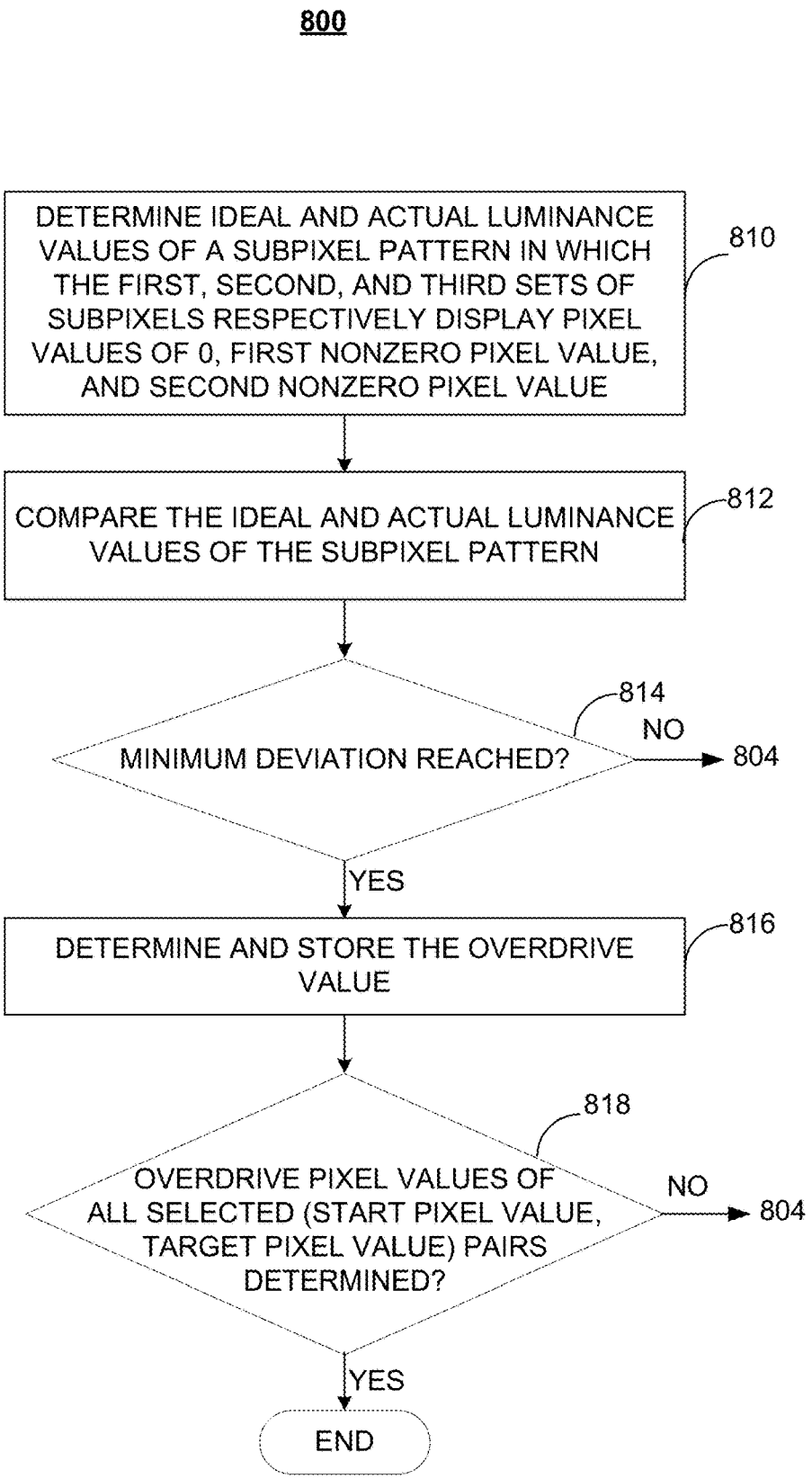

FIGS. 8A and 8B illustrate a flow chart of method 800 for determining the overdrive pixel values for all selected (start pixel value, target pixel value) pairs, in accordance with an embodiment. FIG. 8B is a continuation of FIG. 8A. It will be described with reference to the above figures, e.g., FIGS. 4A-5C. However, any suitable circuit, logic, unit, or module may be employed. The method can be performed by any suitable circuit, logic, unit, or module that can comprise hardware (e.g., circuitry, dedicated logic, programmable logic, microcode, etc.), software (e.g., instructions executing on a processing device), firmware, or a combination thereof. It is to be appreciated that not all steps may be needed to perform the disclosure provided herein. Further, some of the steps may be performed simultaneously, or in a different order than shown in FIGS. 8A and 8B, as will be understood by a person of ordinary skill in the art.

Starting at 802, initial settings of the display panel may be determined. The initial settings may include any suitable settings during an initialization process for the subsequent operation to determine the overdrive pixel value of a (start pixel value, target pixel value) pair. In some embodiments, the initial settings include a definition of a display type (e.g., single-gate arrangement or dual-gate arrangement) of the display panel and a determination of a plurality of selected started pixel values and target pixel values. For example, the selected pixel values and the target pixel values may each be one of 16, 32, 48, 64, 80, 96, 112, 128, 144, 160, 176, 192, 208, 224, 240, and 255. This At 804, a subpixel arrangement may be determined. The subpixel arrangement may include a first, second, and third sets of subpixels arranged consecutively in the display panel. This process may be performed by the pre-processing module 405. At 806, it is determined whether the subpixel arrangement has been generated or the wait time for generating the subpixel arrangement is reached. If the condition in 806 is satisfied, the process is directed to 808. Otherwise, the process is directed back to 806. This process is performed by pre-processing module 405. In some embodiments, pre-processing module 405 sends control signals to a field-programmable gate array (FPGA) to generate the subpixel arrangement. In some embodiments, pre-processing module 405 checks weather the subpixel arrangement has been generated. At 808, the total ideal luminance values of a pattern displaying pixel values of 0 and a second nonzero pixel value may be respectively determined, and the actual luminance value of a pattern in which the first, second, and third sets of subpixels respectively display pixel values of 0, a first nonzero pixel value, and 0 may be determined. The first and second nonzero pixel values may respective be the start and target pixel values. This process may be performed by pre-processing module 405 or post-processing module 408.

At 810, the ideal and actual luminance values of a pattern in which the first, second, and third sets of subpixels respectively display pixel values of 0, first nonzero pixel value, and second nonzero pixel value. The first nonzero pixel value may be a start pixel value, and the second nonzero pixel value may be a target pixel value. This process may be performed by pre-processing module 405 or post-processing module 408. At 812, the ideal and actual luminance values of the pattern may be compared. The actual pixel value inputted into the third set of subpixels may be adjusted so the actual luminance value of the pattern can approach the ideal luminance value of the pattern. This process may be performed by pre-processing module 405 or post-processing module 408. At 814, it may be determined that whether the minimum deviation of the actual and ideal luminance values of the pattern has been reached. If the condition of 814 is satisfied, the process is directed to 816. Otherwise, the process is directed to 804. At 816, the overdrive pixel value may be the pixel value inputted into the third set of subpixels when the minimum deviation between the ideal and the actual luminance values of the pattern is reached. This process may be performed by pre-processing module 405 or post-processing module 408. In some embodiments, the overdrive pixel value is stored in memory 112 in a LUT that reflects a mapping correlation between the first nonzero pixel value and the second pixel value. This process may be performed by pre-processing module 405 or post-processing module 408. At 818, it may be determined whether the overdrive pixel values of all selected (start pixel value, target pixel value) pairs have been determined. If condition of 818 is satisfied, the process is directed to end. Otherwise, the process is directed to 804.

In some embodiments, a bilinear interpolation is performed to calculate the intermediate pixel values not obtained by method 800. For example, a bilinear interpolation may be performed to calculate pixels between two (first nonzero pixel value, second nonzero pixel value) pairs, e.g., two (start pixel value, target pixel value) pairs. In some embodiments, a LUT that has all start pixel values (e.g., 0-255) and all target pixel values (e.g., 0-255), and overdrive pixel values mapped to all (start pixel value, target pixel value) pairs. In some embodiments, processor 110 or control logic 104 obtains overdrive pixel value mapped to a (start pixel value, target pixel value) pair when generating pixel values for subpixels/pixels. For example, for subpixels in a single-gate arrangement, when two consecutive rows sequentially display a (start pixel value, target pixel value) pair, the overdrive pixel value inputted into the second row may be obtained from the LUT. The overdrive pixel value may compensate any defects and/or deviation of luminance value of the second row under the effect of the first row. The actual luminance value of the second row may reach or almost reach the luminance value corresponding to the target pixel value. In some embodiments, a ratio of a measured luminance value of all color channels over a superposition of measured luminance values of each single color channel may be close to 1.

Also, integrated circuit design systems (e.g. work stations) are known that create wafers with integrated circuits based on executable instructions stored on a computer-readable medium such as but not limited to CDROM, RAM, other forms of ROM, hard drives, distributed memory, etc. The instructions may be represented by any suitable language such as but not limited to hardware descriptor language (HDL), Verilog or other suitable language. As such, the logic, units, and circuits described herein may also be produced as integrated circuits by such systems using the computer-readable medium with instructions stored therein.

For example, an integrated circuit with the aforedescribed logic, units, and circuits may be created using such integrated circuit fabrication systems. The computer-readable medium stores instructions executable by one or more integrated circuit design systems that causes the one or more integrated circuit design systems to design an integrated circuit. In one example, the designed integrated circuit includes a graphics pipeline, a pre-processing module, and a data transmitter. The graphics pipeline is configured to generate a set of original display data in each frame. The pre-processing module is configured to determine the computing resources of compensation processes for a still portion and a moving portion of an image and perform multi-frame compensation process on pixels that display the still portion of the image in a plurality of frames. The data transmitter is configured to transmit, to control logic operatively coupled to the display, in each frame, a stream of display data comprising original display data and the corresponding compensation data.

The above detailed description of the disclosure and the examples described therein have been presented for the purposes of illustration and description only and not by limitation. It is therefore contemplated that the present disclosure covers any and all modifications, variations or equivalents that fall within the spirit and scope of the basic underlying principles disclosed above and claimed herein.

What is claimed is:

1. A method for determining an overdrive mapping correlation in a display panel, comprising:

determining a repeating subpixel arrangement that comprises at least three sets of subpixels in the display panel;

determining an ideal luminance value of a pattern of the subpixel arrangement by determining an actual luminance value of another pattern of the subpixel arrangement, the pattern comprising at least a first set of subpixels displaying a zero pixel value, a second set of subpixels displaying a first nonzero pixel value, and a third set of subpixels displaying a second nonzero pixel value, the first, second, and third sets of subpixels respectively arranged one after another, the first nonzero pixel value being different from the second nonzero pixel value, and the other pattern comprising the second set of subpixels displaying the first nonzero pixel value and the rest of the plurality of subpixels displaying the zero pixel values;

determining an actual luminance value of the pattern of the subpixel arrangement; and determining an overdrive pixel value from the first nonzero pixel value to the second nonzero pixel value by matching the actual luminance value of the pattern to the ideal luminance value of the pattern.

2. The method of claim 1, wherein determining the ideal luminance value of the pattern of the subpixel arrangement comprises:

determining ideal luminance values of the zero pixel value and the second nonzero pixel value;

determining the actual luminance value of the other pattern of the subpixel arrangement; and calculating the ideal luminance value of the pattern of the subpixel arrangement based on the ideal luminance values of the zero pixel value and the second nonzero pixel value and the actual luminance value of the other pattern of the subpixel arrangement.

3. The method of claim 2, wherein determining the ideal luminance values of the zero pixel value and the second nonzero pixel value comprises:

determining actual luminance values of a third pattern of the subpixel arrangement, the third pattern respectively comprising each of the at least three sets of subpixels displaying the zero pixel value and the second nonzero pixel value.

4. The method of claim 3, wherein matching the actual luminance value of the pattern to the ideal luminance value of the pattern comprises adjusting an actual pixel value inputted into the third set of subpixels until an actual luminance value of the pattern matches the ideal luminance value of the pattern.

5. The method of claim 4, wherein adjusting the actual pixel value inputted into the third set of subpixels until the actual luminance value of the pattern matches the ideal luminance value of the pattern comprises:

in response to the actual luminance value of the pattern being less than the ideal luminance value of the pattern, increasing the actual pixel value until the ideal luminance value of the pattern is between the $(m-1)^{th}$ and the $m^{th}$ adjusted actual luminance values of the pattern, m being a positive integer; and in response to the actual luminance value of the pattern being greater than the ideal luminance of the pattern, decreasing the actual pixel value until the ideal luminance value of the pattern is between the $(n-1)^{th}$ and the $n^{th}$ adjusted actual luminance values of the pattern, n being a positive integer.

6. The method of claim 5, wherein increasing the actual pixel value comprises increasing the actual pixel value inputted into the third set of subpixels by a step length of 1; and the overdrive pixel value is equal to a pixel value corresponding to one of the $(m-1)^{th}$ and the $m^{th}$ adjusted luminance values of the pattern that has a smaller difference than the ideal luminance value of the pattern.

7. The method of claim 5, wherein decreasing the actual pixel value comprises decreasing the actual pixel value inputted into the third set of subpixels by a step length of 1; and the overdrive pixel value is equal to a pixel value corresponding to one of the $(n-1)^{th}$ and the $n^{th}$ adjusted luminance values of the pattern that has a smaller difference than the ideal luminance value of the pattern.

8. The method of claim 7, wherein the repeating subpixel arrangement includes a single-gate subpixel arrangement and the at least three sets of subpixels comprises three consecutive rows of subpixels;

the pattern of the subpixel arrangement comprises a first row of subpixels displaying the zero pixel value, a second row of subpixels displaying the first nonzero pixel value, and a third row of subpixels displaying the second nonzero pixel value;

the other pattern of subpixel arrangement comprises the second row of subpixels displaying the first nonzero pixel values, and the first and third rows of subpixels displaying the zero pixel value; and the third pattern of subpixel arrangement comprises the first, second, and third rows of subpixels all respectively displaying the zero pixel value and the second pixel value.

9. The method of claim 7, wherein the repeating subpixel arrangement includes a dual-gate subpixel arrangement, and the at least three sets of subpixels comprise six consecutive rows of subpixels;

the pattern of the subpixel arrangement comprises a first and fourth rows of subpixels displaying the zero pixel value, a second and fifth rows of subpixels displaying the first nonzero pixel value, and a third and sixth rows of subpixels displaying the second nonzero pixel value;

the other pattern of subpixel arrangement comprises the second and fourth row of subpixels displaying the first nonzero pixel values, and the first, third, fifth, and sixth rows of subpixels displaying the zero pixel value; and the third pattern of subpixel arrangement comprises the six consecutive rows of subpixels all respectively displaying the zero pixel value and the second pixel value.

10. The method of claim 3, wherein the first and second nonzero pixel values is each equal to one of 16, 32, 48, 64, 80, 96, 112, 128, 144, 160, 176, 192, 208, 224, 240, and 255.

11. The method of claim 10, further comprising determining a plurality of intermediate overdrive pixel values between the first and second nonzero pixel values.

12. The method of claim 11, wherein determining the plurality of intermediate overdrive pixel values comprises performing a bilinear interpolation process to determine intermediate pixel values between two pixel value pairs, each pixel value pair comprising a first nonzero pixel value and a second nonzero pixel value.

13. A system for determining an overdrive mapping correlation in a display panel, comprising:

a display having a plurality of subpixels; and a processor, comprising:

a graphics pipeline configured to generate a plurality of pixel values for the plurality of subpixels in each frame, a pre-processing module configured to:

determine a repeating subpixel arrangement that comprises at least three sets of subpixels in the display panel;

determine an ideal luminance value of a pattern of the subpixel arrangement by determining an actual luminance value of another pattern of the subpixel arrangement, the pattern comprising at least a first set of subpixels displaying a zero pixel value, a second set of subpixels displaying a first nonzero pixel value, and a third set of subpixels displaying a second nonzero pixel value, the first, second, and third sets of subpixels respectively arranged one after another, the first nonzero pixel value being different from the second nonzero pixel value, and the other pattern comprising the second set of subpixels displaying the first nonzero pixel value and the rest of the plurality of subpixels displaying the zero pixel values, determine an actual luminance value of the pattern of the subpixel arrangement, and determine an overdrive pixel value from the first nonzero pixel value to the second nonzero pixel value by matching the actual luminance value of the pattern to the ideal luminance value of the pattern;

a luminance measuring unit configured to measure the actual luminance value of the pattern of the subpixel arrangement and transmit the actual luminance value of the pattern to the pre-processing module; and a data transmitter configured to transmit the plurality of pixel values from the processor to the display in the frame.

14. The system of claim 13, wherein determining the ideal luminance value of the pattern of the subpixel arrangement comprises:

determining ideal luminance values of the zero pixel value and the second nonzero pixel value;

determining the actual luminance value of the other pattern of the subpixel arrangement; and calculating the ideal luminance value of the pattern of the subpixel arrangement based on the ideal luminance values of the zero pixel value and the second nonzero pixel value and the actual luminance value of the other pattern of the subpixel arrangement.

15. The system of claim 14, wherein determining the ideal luminance values of the zero pixel value and the second nonzero pixel value comprises:

determining actual luminance values of a third pattern of the subpixel arrangement, the third pattern respectively comprising each of the at least three sets of subpixels displaying the zero pixel value and the second nonzero pixel value.

16. The system of claim 15, wherein matching the actual luminance value of the pattern to the ideal luminance value of the pattern comprises adjusting an actual pixel value inputted into the third set of subpixels until an actual luminance value of the pattern matches the ideal luminance value of the pattern.

17. The system of claim 16, wherein adjusting the actual pixel value inputted into the third set of subpixels until the actual luminance value of the pattern matches the ideal luminance value of the pattern comprises:

in response to the actual luminance value of the pattern being less than the ideal luminance value of the pattern, increasing the actual pixel value until the ideal luminance value of the pattern is between the $(m-1)^{th}$ and the $m^{th}$ adjusted actual luminance values of the pattern, m being a positive integer; and in response to the actual luminance value of the pattern being greater than the ideal luminance of the pattern, decreasing the actual pixel value until the ideal luminance value of the pattern is between the $(n-1)^{th}$ and the $n^{th}$ adjusted actual luminance values of the pattern, n being a positive integer.

18. The system of claim 17, wherein increasing the actual pixel value comprises increasing the actual pixel value inputted into the third set of subpixels by a step length of 1; and the overdrive pixel value is equal to a pixel value corresponding to one of the $(m-1)^{th}$ and the $m^{th}$ adjusted luminance values of the pattern that has a smaller difference than the ideal luminance value of the pattern.

19. The system of claim 17, wherein decreasing the actual pixel value comprises decreasing the actual pixel value inputted into the third set of subpixels by a step length of 1; and the overdrive pixel value is equal to a pixel value corresponding to one of the $(n-1)^{th}$ and the $n^{th}$ adjusted luminance values of the pattern that has a smaller difference than the ideal luminance value of the pattern.

20. A non-transitory computer-readable medium that stores a set of instructions, when executed by at least one processor, cause the at least one processor to determine a method for determining an overdrive mapping correlation in a display panel, the method comprising:

determining a repeating subpixel arrangement that comprises at least three sets of subpixels in the display panel;

determining an ideal luminance value of a pattern of the subpixel arrangement by determining an actual luminance value of another pattern of the subpixel arrangement, the pattern comprising at least a first set of subpixels displaying a zero pixel value, a second set of subpixels displaying a first nonzero pixel value, and a third set of subpixels displaying a second nonzero pixel value, the first, second, and third sets of subpixels respectively arranged one after another, the first nonzero pixel value being different from the second nonzero pixel value, and the other pattern comprising the second set of subpixels displaying the first nonzero pixel value and the rest of the plurality of subpixels displaying the zero pixel values;

determining an actual luminance value of the pattern of the subpixel arrangement; and determining an overdrive pixel value from the first nonzero pixel value to the second nonzero pixel value by matching the actual luminance value of the pattern to the ideal luminance value of the pattern.

* * * * *